US005569060A

United States Patent [19]

Mori et al.

[11] Patent Number: 5,569,060

[45] Date of Patent: Oct. 29, 1996

[54] ON-LINE ROLL GRINDING APPARATUS

[75] Inventors: Shigeru Mori; Yasuharu Imagawa, both of Hitachi, Japan

[73] Assignee: Hitachi, Ltd., Tokyo, Japan

[21] Appl. No.: 250,674

[22] Filed: May 27, 1994

Related U.S. Application Data

[63] Continuation-in-part of Ser. No. 70,760, Jun. 3, 1993.

[30] Foreign Application Priority Data

May 27, 1993 [JP] Japan ..... 5-126189

[51] Int. Cl.[6] ..... B24B 5/37

[52] U.S. Cl. ..... 451/5; 451/49; 451/425

[58] Field of Search ..... 451/49, 5, 11, 451/14, 424, 425, 426, 548, 160

[56] References Cited

U.S. PATENT DOCUMENTS

| | | | |
|---|---|---|---|
| 4,619,080 | 10/1986 | Okamoto et al. | 451/424 |
| 4,716,687 | 1/1988 | Tsukamoto et al. | 451/49 |

FOREIGN PATENT DOCUMENTS

| | | |
|---|---|---|
| 58-28706 | 8/1956 | Japan . |
| 58-28705 | 8/1956 | Japan . |
| 61-88907 | 5/1986 | Japan . |
| 61-242711 | 10/1986 | Japan . |
| 62-95867 | 6/1987 | Japan . |
| 62-174705 | 11/1987 | Japan . |

OTHER PUBLICATIONS

Development of On–Line Roll Grinders; Mitsubishi Giho, vol. 25, No. 4, 1988.

On–Line Constant Pressure Grinding . . . Procedings of 1992 Spring Lecture Mtg. of Precision Engineering Society of Japan.

*Primary Examiner*—Robert A. Rose

*Attorney, Agent, or Firm*—Evenson McKeown Edwards & Lenahan, PLLC

[57] ABSTRACT

A grinding unit 5 comprises grinding wheel 20, a driving device 22 for driving the grinding wheel, and a shifting device 23. When the grinding wheel is subject to vibration of a work roll 1*a*, vibrating energy is absorbed by deflection of a plain wheel 52 which is integral with an abrasive layer 51 of the grinding wheel and has an elastically deforming function. A rail frame 7 is moved by rail moving devices 30 to tilt a grinding wheel spindle 21 with respect to an axis of the work roll 1*a*. The rail frame 7 is tilted in opposite directions with respect to the axis of the work roll between when the grinding unit 5 is positioned to grind one end side of the work roll 1*a* and when it is positioned to grind the other end side thereof. In an on-line roll grinding apparatus, vibration from the work roll is absorbed to enable precise grinding with good roughness of the roll surface without giving rise to any chattering marks, and one work roll can be ground by a single grinding unit up to both roll ends.

33 Claims, 19 Drawing Sheets

ON-LINE ROLL GRINDING APPARATUS

CROSS-REFERENCE TO RELATED APPLICATION

This is a continuation-in-part of U.S. Ser. No. 08/070,760 filed on Jun. 3, 1993, pending, the contents of which are incorporated herein by reference.

BACKGROUND OF THE INVENTION

The present invention relates to a rolling mill, and more particularly to an on-line roll grinding apparatus installed in a strip rolling mill. Especially, the invention relates to an on-line roll grinding apparatus for effectively grinding rolls on-line without being affected by influences of vibration of work rolls.

Generally, when slabs are rolled by work rolls of a strip rolling mill, there occurs a periphery difference between the rolling zone and the unrolling zone because only the former is abraded or worn away. This imposes restrictions upon the rolling operation when rolling slabs of different widths. To solve that problem, there have been proposed various techniques and control methods in relation to on-line roll grinders.

For example, according to "Development of On-Line Roll Grinders", Mitsubishi Giho, Vol. 25, No. 4, 1988 and JP, U, 62-174705, a plurality of cup grinding stones are arranged along one work roll and mounted in a one-piece frame, the frame being always moved in its entirety over a certain range, and the cup grinding stones are not positively driven to rotate but passively driven (dragged) with the aid of torque of the work roll, thereby grinding the entire surface of the work roll (hereinafter referred to as first prior art).

Also, JP, U, 58-28705 discloses a technique wherein one roll grinding unit is disposed for one work roll, contact rolls serving as position sensors are held in contact with neck portions at both ends of the work roll on the side thereof opposite to the roll grinding unit, the position sensors detecting an offset of the work roll axis, and a shifting device is controlled to move a grinding wheel following the detected offset (hereinafter referred to as second prior art).

Further, "On-Line Constant Pressure Grinding for Work Rolls", Proceedings of 1992 Spring Lecture Meeting of Precision Engineering Society of Japan, reports an experimental result of forming an abrasive layer of a cup grinding stone using abrasives of cubic boron nitride (CBN), arranging a spindle of the grinding stone substantially perpendicularly to the axis of a work roll, and grinding the work roll (hereinafter referred to as third prior art).

In addition, JP, U, 58-28706 and JP, U, 62-95867 disclose a technique that a cup grinding stone arranged substantially perpendicularly to a work roll is mounted to a spindle slidably in its axial direction, and the grinding stone is axially supported at its backside by an elastic body directly or via a boss, thereby absorbing vibration of the work roll (hereinafter referred to as fourth prior art).

According to JP, A, 61-242711, one roll is ground by using only one grinding stone based on the same grinding method as in the above first prior art, and a grinding surface of the grinding stone is reversed near the axial center of the roll for grinding the entire roll length (hereinafter referred to as fifth prior art).

Meanwhile, in relation to an on-line roll grinder for use with a roll crossing mill wherein a strip is rolled by a pair of upper and lower work rolls with their axes inclined in a horizontal plane from a direction perpendicular to the rolling direction, JP, A, 61-88907 discloses one example in which a grinding member is moved in a horizontal plane following a work roll. More specifically, a frame housing the grinding member therein is provided at both transverse ends with a fixed cushion and a free cushion held in abutment with work roll chocks, these two cushions serving to make the frame follow the work roll chocks, and the two cushions are supplied with fluid pressures depending on the moment of rotation produced from the difference in pressing reaction of the grinding member held in contact with a work roll at both the frame ends, thereby balancing the moment of rotation (hereinafter referred to as sixth prior art).

SUMMARY OF THE INVENTION

Work rolls of a rolling mill are each held by bearings assembled in roll chocks and are rotated at a high speed. The roll chocks each have gaps in their inner and outer circumferences for facilitating replacement of the work roll and the bearing. During rotation, therefore, the work roll is rotated while moving back and forth in the gaps. In addition, a cylindrical portion of the work roll is offset with respect to the bearings, and the work roll is vertically moved by a screwdown device during strip rolling. As a result of those movements combined with each other, the work roll is rotated while vibrating at all times.

Generally, when grinding cylindrical workpieces, the workpiece to be ground is supported by a tail stock rotating with high precision to carry out the grinding under a condition that vibration of the work is suppressed to be as small as practicable. In an attempt to grind the work roll while rolling a strip in the rolling mill, however, it is impossible to carry out the grinding under a condition of very small vibration like with workpieces in the above ordinary case. During the rolling, the work roll is rotated while vibrating usually with an amplitude of 20 μm to 60 μm and an acceleration of 1 G to 2 G. An on-line roll grinding apparatus must precisely grind the work roll under such a condition.

With the above first to third and fifth prior arts, when they are applied to the grinding of such a vibrating work roll, they produce irregularities on the surface of the work roll due to chattering marks. Also, the grinding stone or wheel is remarkably worn away with the impact force caused by chattering, and its service life is so shortened as to require more frequent replacement. Further, it is difficult to control the contact force in the case of grinding the work roll into a predetermined profile.

Also, since the grinding stones are rotated by being dragged with the torque of the work roll, the grinding ability per stone is not so high. Therefore, six or more grinding members are required for each work roll. In the case of a rolling mill having a short roll length, there is no space sufficient for enabling the frame, in which the plurality of grinding members are housed, to be movable in the axial direction of the roll. In the fifth prior art, since the single grinding stone is rotated by being dragged, the grinding ability is further reduced.

The above fourth prior art is designed to absorb the vibration of the work roll by the elastic body. With this prior art, however, since the entire grinding stone including a stone base is supported by the elastic body and moved back and forth, there accompanies a problem that the movable mass of the grinding stone, i.e., the weight of a portion which is forced to move following the vibration, is great.

Even in the case of using, as the abrasive layer of the grinding stone, abrasives of cubic boron nitride (CBN) which has a high grinding ratio, the movable mass of the grinding stone supported by the elastic body and moving back and forth is at least more than 5 Kg, including the stone itself, of which the diameter is assumed to be 250 mm, slide bearings and sealing parts. Supposing that an allowable value of change in the contact force between the work roll and the grinding stone is 4 Kgf and the amplitude of vibration of the work roll is 30 μm, the spring constant of the elastic body must be set to 130 Kgf/mm. Under the above conditions, the natural frequency of the movable portion including the elastic body is calculated to be 80 c/s. The movable portion including the elastic body, which has such a low natural frequency, is caused to resonate with the vibration of the work roll, thereby producing chattering marks on the roll surface and accelerating abrasion of the grinding stone. If the stone size is reduced to make the movable mass smaller, the grinding ability would be lowered to a large extent.

The cup grinding stone is slidable in the axial direction of the spindle and supported at its backside by the elastic body. During the roll grinding, however, a coolant, grinding dust and the like are scattered around the grinding stone, and these foreign matters may enter clearances between the grinding stone and the spindle through seals provided on the rotating stone to impede smooth movement of the grinding stone. It is therefore difficult for the elastic body to stably develop its function for a long period of time.

In the fifth prior art, the grinding surface of the grinding stone is reversed (by changing an inclination of the spindle) near the axial center of the roll for grinding the entire roll length by the single stone. But the practical structure for realizing it is not disclosed.

On the other hand, the sixth prior art related to a roll grinder for roll crossing mills is designed to absorb the vibration from the work roll by the cushions provided at both ends of the frame. As with the fourth prior art, however, the movable portion is caused to resonate because of its great mass, resulting in the problems that irregularities due to chattering marks are produced on the surface of the work roll and the service life of the grinding stone is shortened.

Further, since the grinding member is not rotated in the grinder of the sixth embodiment, a great pressing force is required to effect the grinding and reactions at both ends of the frame, in which the grinding member is housed, are unbalanced. To balance the reactions and to make the frame follow the roll crossing angle, two cushions are necessary and the fluid pressures injected to these cushions must be properly controlled. This raises another problem that the structure is complicated.

A first object of the present invention is to provide an on-line roll grinding apparatus in which vibration from a roll is absorbed to enable precise grinding with good roughness of the roll surface without giving rise to any chattering marks, and one roll can be ground by a single grinding unit up to both roll ends.

A second object of the present invention is to provide an on-line roll grinding apparatus in which vibration from a roll is absorbed to enable precise grinding with good roughness of the roll surface without giving rise to any chattering marks, and a grinding unit can be moved following the roll crossing angle with a simple construction.

To achieve the above first object, according to the present invention, there is provided an on-line roll grinding apparatus equipped on a rolling mill including at least one pair of rolls rotatably supported between opposite stands, said apparatus comprising a single grinding unit provided for at least one roll and a rail frame for supporting said grinding unit movably in the axial direction of said roll, said grinding unit comprising a planar type grinding wheel for grinding said roll, driving means for rotating said grinding wheel through a spindle, shifting means for pressing said grinding wheel against said roll, and traversing means for moving said grinding unit along said rail frame, wherein said grinding wheel comprises a planar wheel disk attached to said spindle and an abrasive layer fixed to one side of said plain wheel, said planar wheel disk having an elastically deforming function to absorb vibration transmitted from said roll; and said apparatus further comprises rail tilting means for changing a tilt of said rail frame with respect to said stands while keeping the direction of movement of said grinding wheel parallel to the axis of said roll when said grinding unit is moved along said rail frame.

In the above grinding apparatus, preferably, said rail tilting means comprises guide means provided on said opposite stands for supporting said rail frame tiltably with respect to said stands, rail position control means for controlling said rail frame to be tilted in opposite directions with respect to the axis of said roll between when said grinding unit is positioned to grind one end side of said roll and when said grinding unit is positioned to grind the other end side of said roll, and wheel position control means for keeping the direction of movement of said grinding wheel parallel to the axis of said roll when said grinding unit is moved along said rail frame.

Also preferably, said rail position control means comprises rail moving means including an actuator provided on at least one of said stands and moving said rail frame with respect to said stands in the direction toward or away from said roll, and means for controlling energization of said actuator so that the direction of movement of said rail frame is reversed between when said grinding unit is positioned to grind one end side of said roll and when said grinding unit is positioned to grind the other end side of said roll.

Further preferably, said wheel position control means is means for driving said shifting means and said traversing means so that said grinding wheel is moved parallel to the axis of said roll regardless of change in the distance between said rail frame and the axis of said roll due to the tilt of said rail frame.

To achieve the above second object, according to the present invention, there is provided an on-line roll grinding apparatus equipped on a roll crossing mill in which at least one pair of rolls rotatably supported between opposite stands are crossed horizontally for rolling strips, said apparatus comprising at least two grinding units provided for at least one roll and a rail frame for supporting said grinding units movably in the axial direction of said roll, each of said grinding units comprising a planar type grinding wheel for grinding said roll, driving means for rotating said grinding wheel through a spindle, shifting means for pressing said grinding wheel against said roll, and traversing means for moving said grinding unit along said rail frame, wherein said grinding wheel comprises a planar wheel disk attached to said spindle and an abrasive layer fixed to one side of said planar wheel disk, said plain wheel having an elastically deforming function to absorb vibration transmitted from said roll; and said apparatus further comprises rail tilting means for changing a tilt of said rail frame with respect to said stands while keeping the direction of movement of said grinding wheel parallel to the axis of said roll when said grinding unit is moved along said rail frame.

In the above grinding apparatus, preferably, said rail tilting means is follow-up moving means for moving said rail frame following a cross angle of said rolls so that said rail frame is kept parallel to the axis of corresponding one of said rolls.

In the above grinding apparatus, preferably, said rail tilting means comprises guide means provided on said opposite stands for supporting said rail frame tiltably with respect to said stands, and rail position control means for controlling said rail frame to be tilted with respect to said stands following a cross angle of said rolls so that said rail frame is kept parallel to the axis of corresponding one of said rolls.

Also preferably, said rail position control means comprises rail moving means including an actuator provided on at least one of said stands and moving said rail frame with respect to said stands in the direction toward or away from said roll, and means for controlling energization of said actuator based on information about the cross angle of said rolls so that said rail frame is kept parallel to the axis of corresponding one of said rolls.

Said rail moving means may include cross blocks provided on said opposite stands for coming into abutment with roll chocks to press the same, said roll chocks supporting respective ends of corresponding one of said rolls, and rail moving means for holding both ends of said rail frame in abutment with said cross blocks so that said rail frame is movable integrally with said cross blocks.

Further preferably, said grinding wheel is disposed such that a contact line between said abrasive layer and said roll is defined only in one side as viewed from the center of said grinding wheel.

In the grinding apparatus concerning the first and second objects, preferably, said rail moving means further comprises stopper means for positioning said rail frame when said rail frame is moved by said actuator in the direction toward or away from said roll. More specifically, said rail moving means further comprises a screw rotated by said actuator, a stopper movable in the direction toward or away from said roll with the rotation of said screw, and urging means for holding said rail frame in abutment with said stopper.

Preferably, said abrasive layer includes cubic boron nitride abrasives or diamond abrasives.

The operation of the present invention thus arranged will be described below.

With regard to matters common to the first and second objects of the present invention, one of the inventors of this application has proposed, in U.S. Ser. No. 08/070,760 (filing date: Jun. 3, 1993), a rolling mill equipped with an on-line roll grinding system comprising a plain type grinding wheel positioned to face one of a pair of mill rolls for grinding the one mill roll, a driving device for rotating the grinding wheel through a spindle, a shifting device for pressing the grinding wheel against the mill roll, and a traversing device for moving the grinding wheel in the axial direction of the mill roll, wherein the grinding wheel comprises a planar wheel disk attached to the spindle and an abrasive layer fixed to one side of the planar wheel disk, the planar wheel disk having an elastically deforming function to absorb vibration transmitted from the mill roll.

With regard to an arrangement of the grinding wheel, the inventor has also proposed to arrange the grinding wheel with the spindle inclined by a small angle relative to the direction perpendicular to an axis of the mill roll, so that a contact line between the abrasive layer and the mill roll is defined only in one side in the roll axial direction as viewed from the center of the grinding wheel.

In the invention of the prior application, with an elastically deforming function imparted to the planar wheel disk as a part of the planar type grinding wheel, when the grinding wheel is pushed with vibration of the mill roll, the planar wheel disk is deflected to momentarily absorb the vibration transmitted from tile mill roll. Accordingly, fluctuations in the contact force between the abrasive layer and the mill roll are held down within a small extent of the elastic force produced upon the deflection of the planar wheel disk, thereby eliminating the occurrence of chattering marks. Further, an elastically deforming function is imparted to the planar wheel disk serving as a base for supporting the abrasive layer so that the abrasive layer is integral with a member having the elastically deforming function. Therefore, only both the abrasive layer and the planar wheel disk provide the mass forced to move with the vibration from the mill roll, whereby the movable mass is very small and the natural frequency of the grinding wheel is raised. Consequently, the vibrating mill roll can be correctly ground for a long period of time without causing any chattering marks due to resonance.

With the spindle inclined to arrange the grinding wheel such that the contact line between the abrasive layer and the mill roll is defined only in one side as viewed from the center of the grinding wheel, the planar wheel disk is allowed to deflect in cantilever fashion under the force to press it against the mill roll, whereby the elastically deforming function of the planar wheel disk is effectively developed to easily absorb the vibration transmitted from the mill roll. Additionally, since the contact line is defined in only one side of the wheel center, the occurrence of chattering marks is further prevented.

The grinding apparatus of the present invention is based on the invention of the prior application described above and operates similarly to the invention of the prior application. In other words, the present grinding apparatus can absorb vibration from a roll to enable precise grinding with good roughness of the roll surface without giving rise to any chattering marks.

As to the first object of the present invention, because equipment specific to a rolling mill, such as strip passing guides, are present near work rolls of the rolling mill and interference with such equipment must be avoided when a grinding unit for an on-line roll grinding apparatus is installed there, it is desired that one roll can be ground over its entire length by a single grinding unit. In order to grind the entire length of the work roll by a single grinding wheel, the grinding ability of the one grinding wheel must be increased to such an extent as to exceed the grinding rate necessary for grinding the work roll to eliminate the periphery difference produced thereon.

It has been confirmed that the grinding wheel of the invention of the prior application exhibits a high grinding ability with the arrangement for grinding that the spindle of the grinding wheel is inclined to provide the contact line at one point between the grinding wheel and the work roll. It is therefore possible to grind the work roll up to both ends by providing the single grinding unit, which has such a grinding wheel, for one work roll.

Meanwhile, when the spindle 21 of the grinding wheel is inclined as with the prior application, the grinding wheel can grind the work roll up to the roll end on the same side as the grinding surface (i.e., the contact line) without protruding out of the roll end, but its portion diametrically opposite to the grinding surface must be moved out of the roll end when grinding the work roll up to the other roll end. In the latter case, because a roll chock and a stand are present outside the roll end, there arises a problem that the grinding wheel interferes with these components and cannot grind the work roll up to the roll end (see FIG. 7). By reversing the inclination of the spindle to change the grinding surface between when grinding one end side of the work roll and when grinding the other end side, the work roll can be ground up to both ends by one grinding wheel. However, if a tilting device for changing the inclination of the spindle is provided, the grinding unit would be enlarged in its construction and, if a tilting device is provided on the grinding unit, the tilting device would interfere with the roll chock before the grinding wheel moves to the roll end.

In the present invention, therefore, the rail frame for supporting the grinding unit is employed and the spindle is inclined with respect to the roll axis by tilting the rail frame with respect to the stands by the rail tilting means. Also, by changing a tilt of the rail frame with respect to the stands, the spindle is reversed in its inclination so as to change the grinding surface of the grinding wheel.

More specifically, the rail frame is supported by the guide means tiltably with respect to the stands, and is tilted by the rail position control means in opposite directions with respect to the axis of the work roll between when the grinding unit is positioned to grind one end side of the work roll and when it is positioned to grind the other end side, so that the inclination of the spindle is reversed between one end side of the work roll and the other end side. As a result, the work roll can be ground up to both ends with no interference of the grinding wheel with the roll chock and the stand.

When the rail frame is tilted as above, the rail frame and the work roll are not parallel to each other. Under this condition, the distance between the grinding wheel and the roll axis is varied, leading to change in the grinding rate. To compensate for such a change in the distance therebetween, in this embodiment, the wheel position control means keeps the direction of movement of the grinding wheel parallel to the axis of the work roll when the grinding unit is moved along the rail frame.

As one example of the rail position control means, the rail moving means including at least one actuator to move the rail frame with respect to the stands in the direction toward or away from the work roll is provided, and energization of the actuator is controlled so that the direction of movement of the rail frame is reversed between when the grinding unit is positioned to grind one end side of the work roll and when it is positioned to grind the other end side, thereby reversing the tilt of the rail frame. In this case, by providing the stopper means for positioning the rail frame, the inclination of the rail frame can be set with high accuracy. Further, by providing the screw in the rail moving means, moving the stopper in the direction toward or away from the work roll with the rotation of the screw, and holding the rail frame in abutment with the stopper by the urging means, the inclination of the rail frame can be set to any desired angle with high accuracy.

In relation to the second object of the present invention, when strips are ground by mounting two or more grinding units on a roll crossing mill in which upper and lower work rolls are crossed with respect to each other, the work rolls can be each easily ground up to both roll ends while moving the grinding wheel so as to follow the cross angle with a simple construction, by changing the tilt of the rail frame with respect to the stands by the rail tilting means, as with the above.

To this end, the rail frame is moved following the cross angle of the work rolls by the follow-up moving means so that the rail frame is kept parallel to the axis of a corresponding one of the work rolls. More specifically, the rail frame is supported by the guide means tiltably with respect to the stands, and is tilted by the rail position control means with respect to the stands following the cross angle of the work rolls so that the rail frame is kept parallel to the axis of the work roll. As one example of the rail position control means, the rail moving means including at least one actuator to move the rail frame with respect to the stands in the direction toward or away from the work roll is provided, and energization of the actuator is controlled based on information about the cross angle of the work rolls so that the rail frame is kept parallel to the axis of the work roll, enabling the grinding wheel to be moved following the cross angle. In this case, by providing the stopper means and the stopper in the rail moving means as with the above, the parallelism between the rail frame and the work roll can be kept under high precision.

When cross blocks are provided on the opposite stands of the rolling mill for coming into abutment with roll chocks and pressing the same, the roll chocks supporting both ends of corresponding one of the work rolls, the rail moving means may comprise rail moving means for holding both ends of the rail frame in abutment with the cross blocks so that the rail frame is movable integrally with the cross blocks.

DETAILED DESCRIPTION OF THE PREFERRED EMBODIMENTS

Preferred embodiments of the present invention will be described hereinafter with reference to the drawings.

To begin with, a description will be made of a first embodiment of the present invention by referring to FIGS. 1 to 10.

Figure 1:
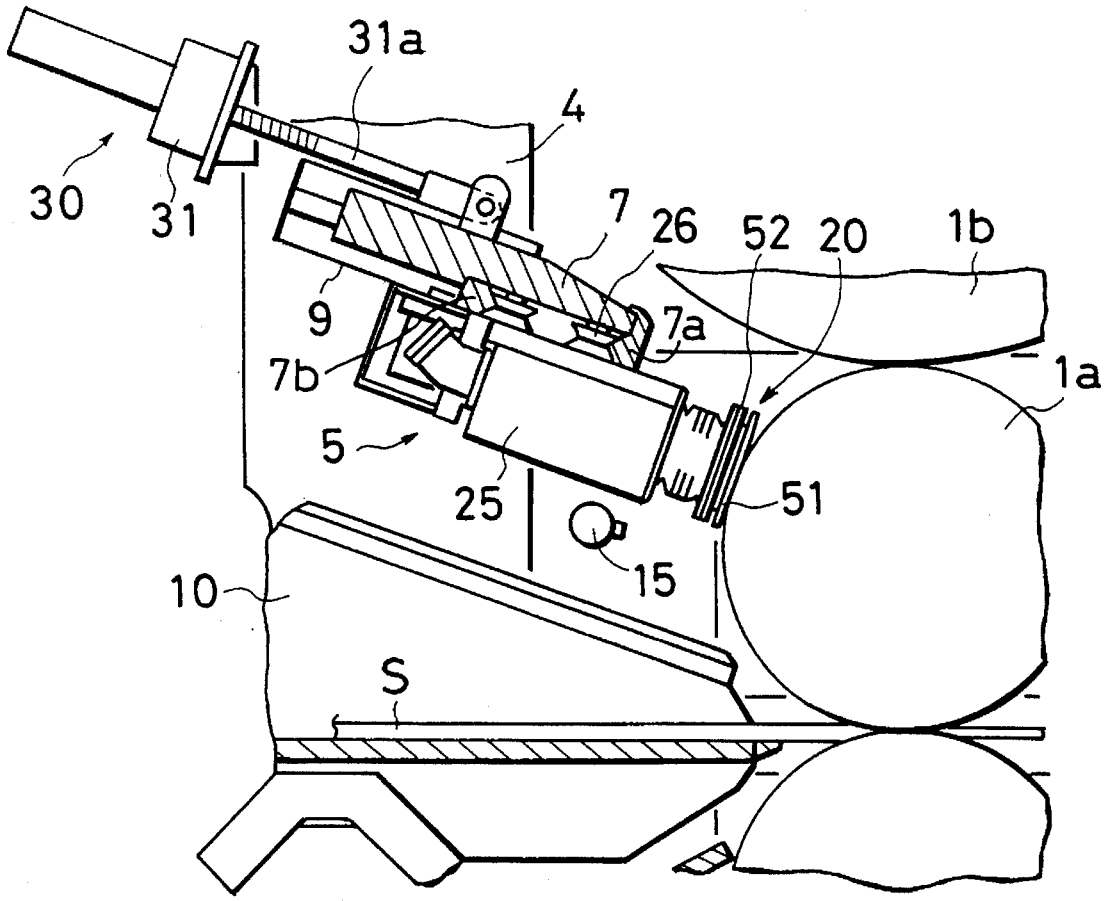
FIG. 1 is a side view, partially sectioned, of principal parts of a rolling mill equipped with an on-line roll grinding apparatus according to one embodiment of the present invention.
Figure 2:
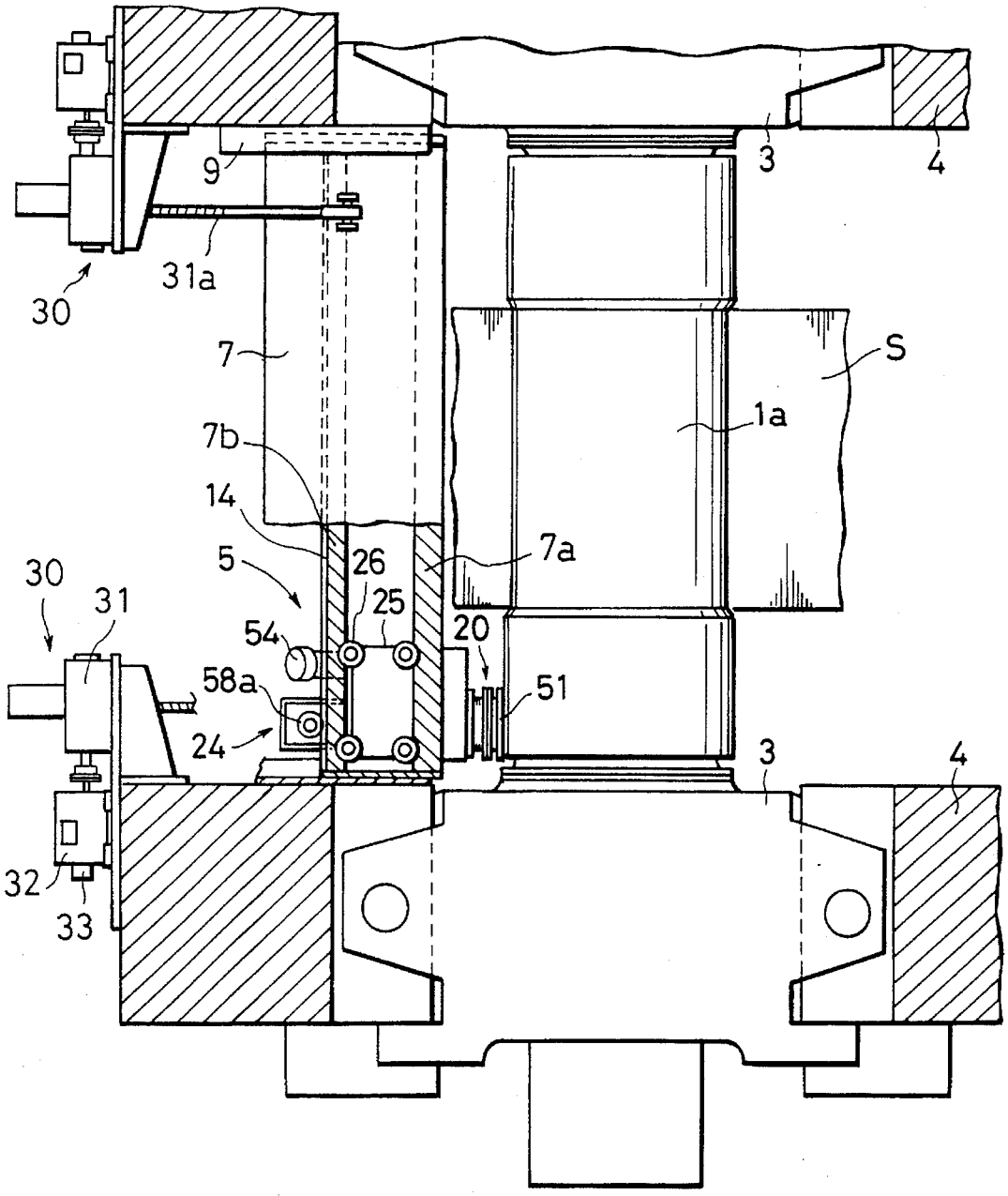
FIG. 2 is a plan view, partially sectioned, of the rolling mill shown in FIG. 1.

In FIGS. 1 and 2, a rolling mill of this embodiment is of a 4-high rolling mill comprising a pair of rolls (upper and lower work rolls) 1*a*, 1*a* for rolling a strip S and a pair of rolls (upper and lower backup rolls) 1*b* (only one shown) for respectively supporting the work rolls 1*a*, 1*a*. The work rolls 1*a*, 1*a* are supported by roll chocks 3, 3 which are assembled into respective stands 4 on the operating and driving sides. An entry guide 10 is disposed on the entry side of-the rolling mill for guiding the strip S to the work rolls 1*a*. There are also provided coolant headers 15 (only one shown) for cooling heat of the work rolls 1*a*, 1*a* generated during the rolling.

Such a rolling mill is equipped with an on-line roll grinding apparatus of this embodiment. The on-line roll grinding apparatus comprises one grinding unit 5 provided for one work roll 1*a*.

Figure 3:
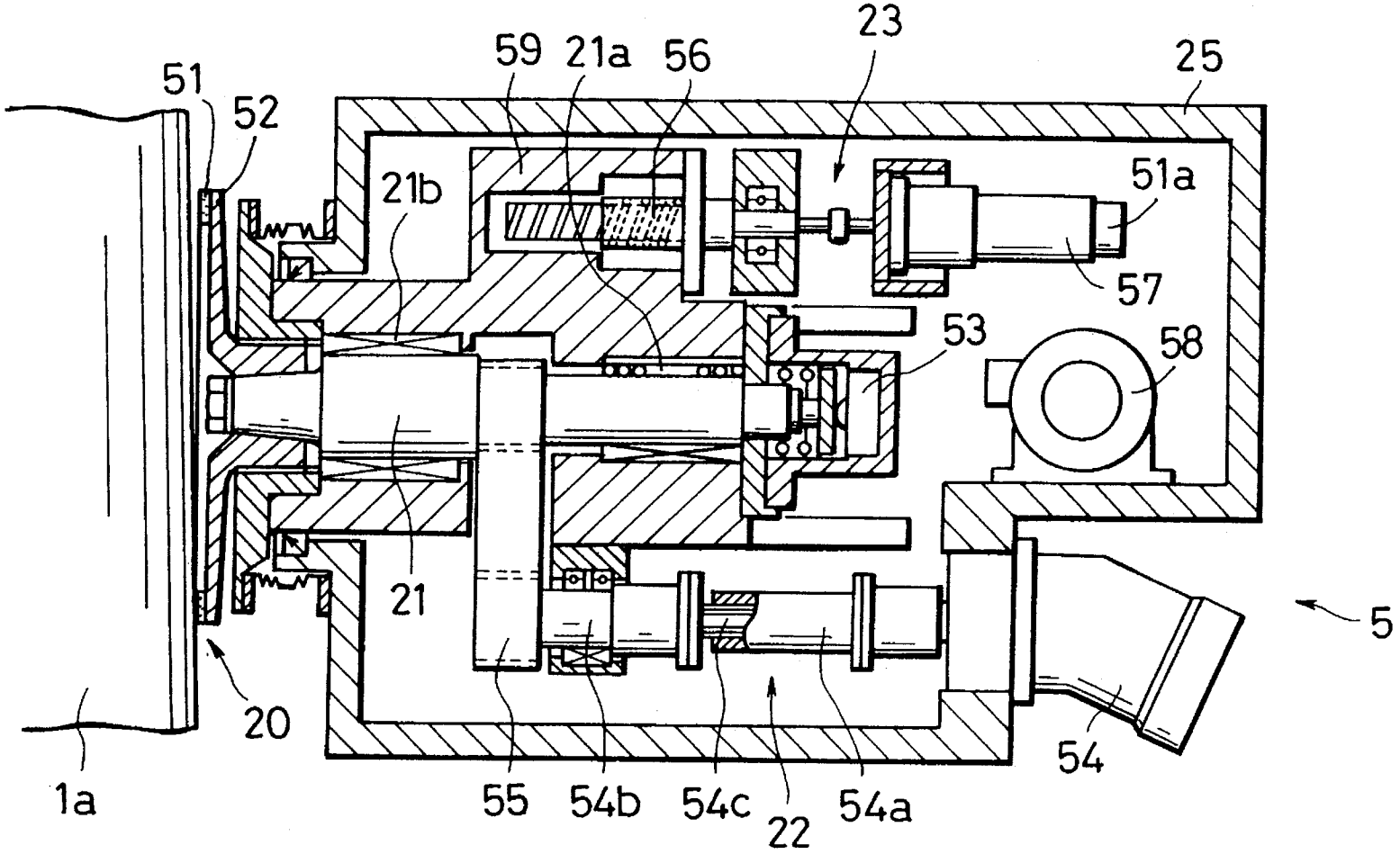
FIG. 3 is a horizontal sectional view of a grinding unit.
Figure 4:
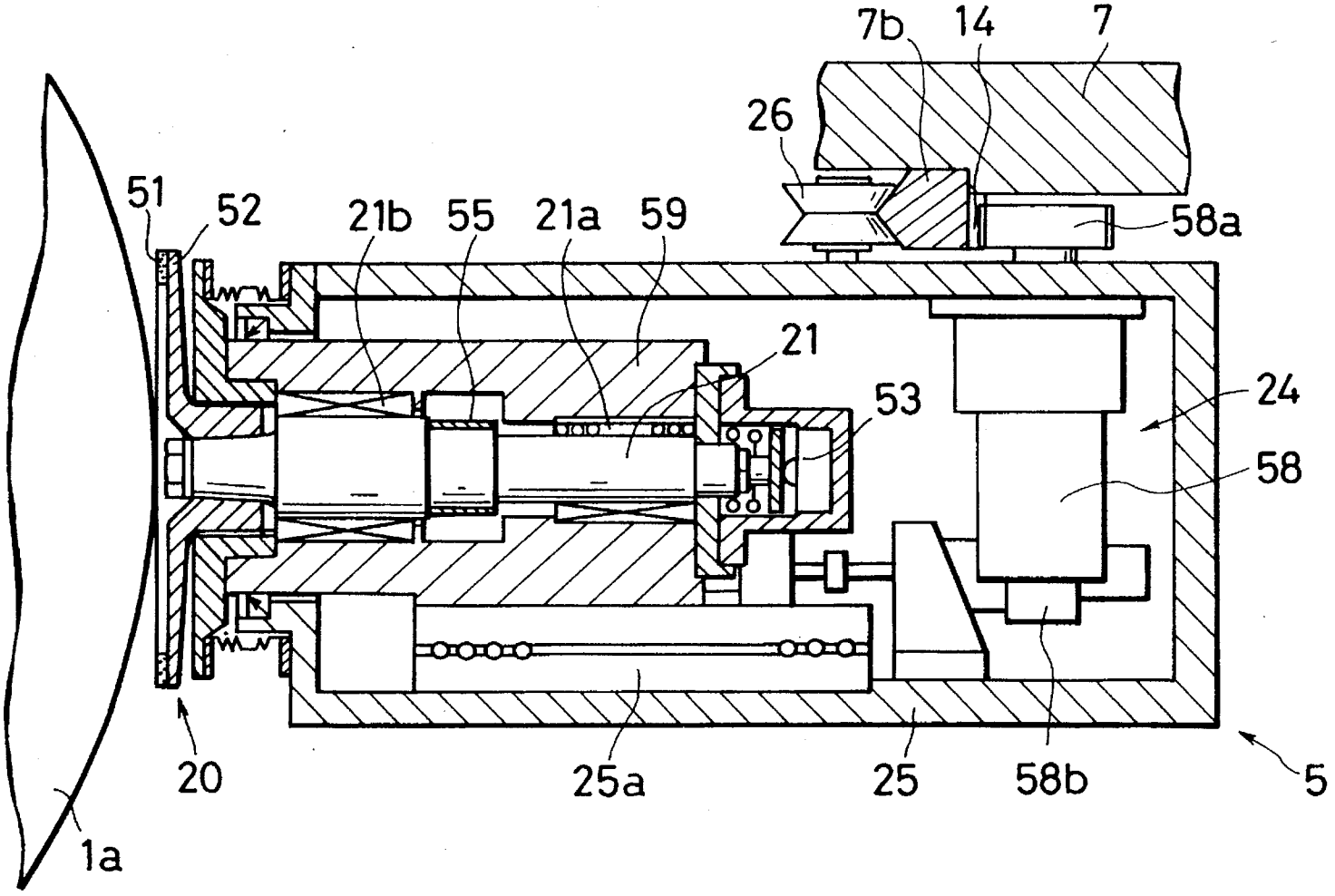
FIG. 4 is a vertical sectional view of the grinding unit.

The grinding unit 5 comprises, as shown in FIGS. 3 and 4, a plain type grinding wheel 20 for grinding the work roll 1*a*, a driving device 22 for rotating the grinding wheel 20 through a spindle 21, a shifting device 23 for pressing the grinding wheel 20 against the work roll 1*a*, and a traversing device 24 for moving the grinding wheel 20 in the axial direction of the work roll 1*a*.

Figure 5:
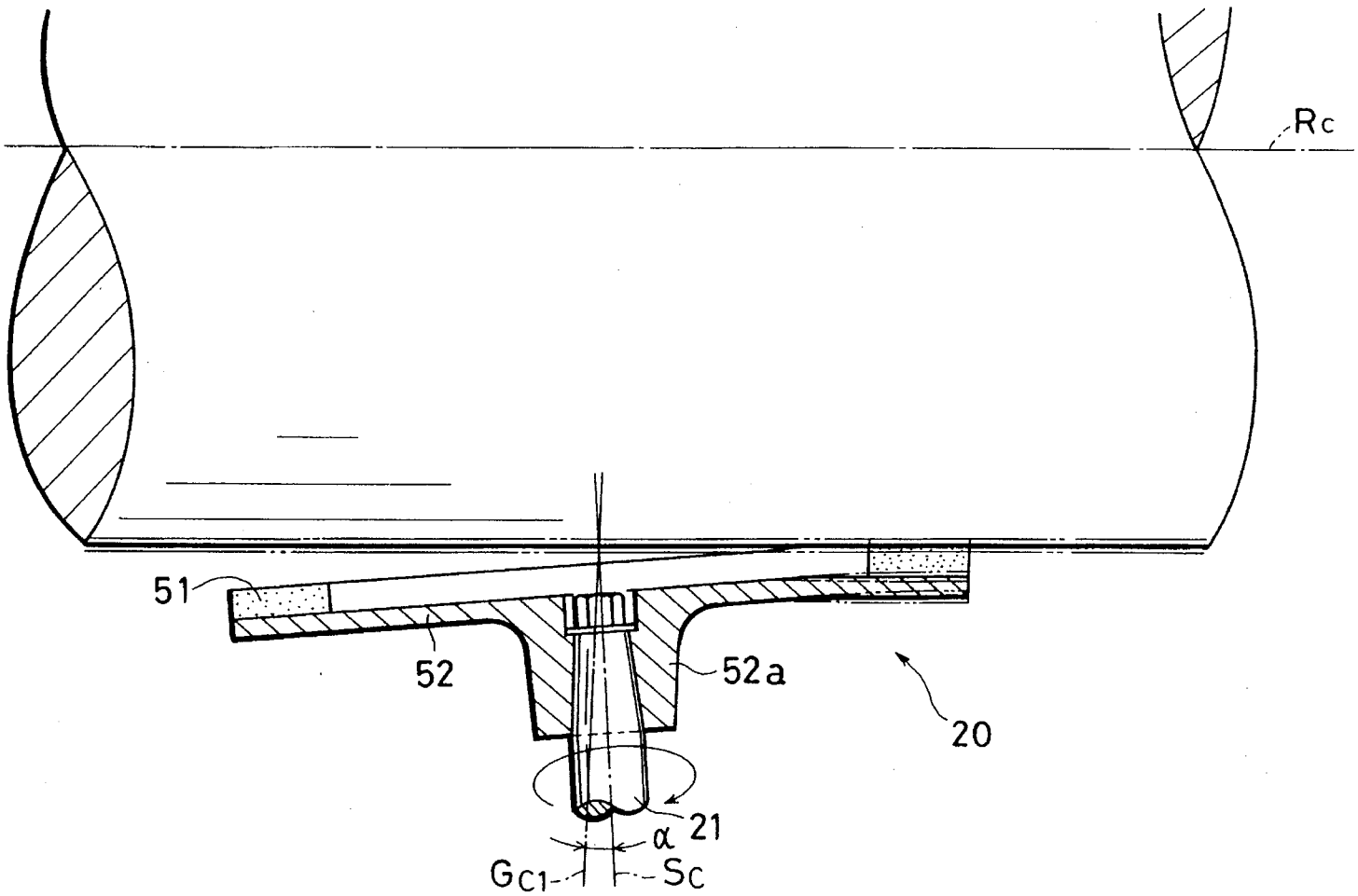
FIG. 5 is a representation showing the arrangement and structure of a grinding wheel and for explaining a vibration absorbing action of the grinding wheel.

As shown in FIG. 5 in an enlarged scale, the grinding wheel 20 comprises a planar wheel disk 52 having a boss 52*a* and an annular abrasive layer 51 fixed to the surface of the planar wheel disk 52 on the side opposite to the boss 52*a*, the planar wheel disk 52 being attached to the spindle 21. Also, the planar wheel disk 52 has an elastically deforming function to absorb vibration from the work roll, and is structured such that its deflection is changed depending on the contact force between the work roll 1*a* and the abrasive layer 51. For the purpose of developing the elastically deforming function, the planar wheel disk 52 preferably has a spring constant of 1000 Kgf/mm to 30 Kgf/mm, more preferably 500 Kgf/mm to 50 Kgf/mm. The abrasive layer 51 is attached integrally with the planar wheel disk 52 by an adhesive so that it can be stably brought into close contact with the vibrating work roll 1*a*.

The abrasive layer 51 is formed of super abrasive grains such as cubic boron nitride (generally called CBN) abrasives or diamond abrasives. The abrasive grains have a concentration in the range of 50 to 100 and a grain size of in the rage of 80 to 180. The abrasive grains are aggregated together by using a resin bond as a binder. Material of the plain wheel 52 is of aluminum or an aluminum alloy for the purpose of easily radiating the grinding heat from the abrasive grains of the abrasive layer 51 and reducing the movable mass of the grinding wheel 20.

As shown in FIG. 5, the grinding wheel 20 is arranged such that an axis Gc1 of the spindle 21 is inclined by a small angle of $\alpha$ relative to a line Sc perpendicular to an axis Rc of the work roll 1*a*, and a contact line between the abrasive layer 51 and the work roll 1*a* is defined only in one side as viewed from the center of the grinding wheel. The angle of inclination $\alpha$ is preferably on the order of 0.5° to 1.0°. Such an arrangement of the grinding wheel 20 makes it possible to effectively develop the elastically deforming function of the plain wheel 52.

The driving device 22 comprises, as shown in FIG. 3, a liquid motor 54 (which may be instead of an electric motor) for driving the grinding wheel 20 to rotate at a predetermined circumferential speed, and a pulley shaft 54*b* and a belt 55 for transmitting rotation of an output shaft 54*a* of the liquid motor 54 to the spindle 21, the output shaft 54*a* and the pulley shaft 54*b* being coupled with each other through parallel splines 54*c*. The pulley shaft 54*b* is rotatably supported by a body 59. The spindle 21 is supported in the body 59 through a pair of slide radial bearings 21*a*, 21*b* in a rotatable and axially movable manner. On the side of the spindle 21 opposite to the grinding wheel 20, a load cell 53 is accommodated in the body 59 for measuring the contact force between the grinding wheel 20 and the work roll 1*a*.

The body 59 is housed in a case 25 and the liquid motor 54 is attached to the case 25. As shown in FIG. 4, the body 59 is mounted onto the bottom of the case 25 through a slide bearing 25*a* to be movable in the axial direction of the spindle 21.

The shifting device 23 comprises, as shown in FIG. 3, a shift motor 57 attached to the case 25, a backlashless pre-loaded ball screw 56 for moving the body 59 upon rotation of the shift motor 57 in the direction toward or away from the work roll 1*a* to thereby shift the grinding wheel 20, the spindle 21 and the load cell 53 together back and forth, and an encoder 57*a* for detecting an angle through which the shift motor 57 is rotated. The pre-loaded ball screw 56 may be replaced by a backlashless gear mechanism.

The traversing device 24 comprises, as shown in FIG. 4, a traverse motor 58 attached to the case 25, a pinion 58*a* fitted over a rotary shaft of the traverse motor 58 and held in mesh with a rack 14, two pairs of guide rollers 26 attached to an upper surface of the case 25 and each pair engaging one of guide rails 7*a*, 7*b*, and an encoder 58*b* for detecting the number of revolutions of the traverse motor 58. As shown in FIGS. 1 and 2, the guide rails 7*a*, 7*b* are attached to a rail frame 7 disposed on the entry side of the work roll 1*a* extending parallel to the axis of the work roll 1*a*. The rack 14 is formed on the side of the guide rail 7*b* opposite to the work roll. Thus, the grinding unit 5 is smoothly movable in the axial direction of the work roll upon rotation of the traverse motor 58 through meshing between the pinion 58*a* and the rack 14, while being supported by the rail frame 7 via the guide rollers 26 and the guide rails 7*a*, 7*b*.

The roll grinding unit 5 is required to be out of interference with the roll chocks 3 when the work roll 1*a* is exchanged. To this end, the rail frame 7 is slidably supported at its both ends on guides 9 attached to the stands 4, so that the grinding unit 5 is movable with the rail frame 7 in the direction toward or away from the work roll 1*a* by rail moving devices 30 provided respectively on the operating and driving sides near both ends of the rail frame 7. Each of the rail moving devices 30 comprises a worm screw 31, a motor 32 for driving the screw 31, and an encoder 33 associated with the motor 32. A screw shaft 31*a* of the worm screw 31 is pin-coupled at its distal end to the rail frame 7.

Figure 6:
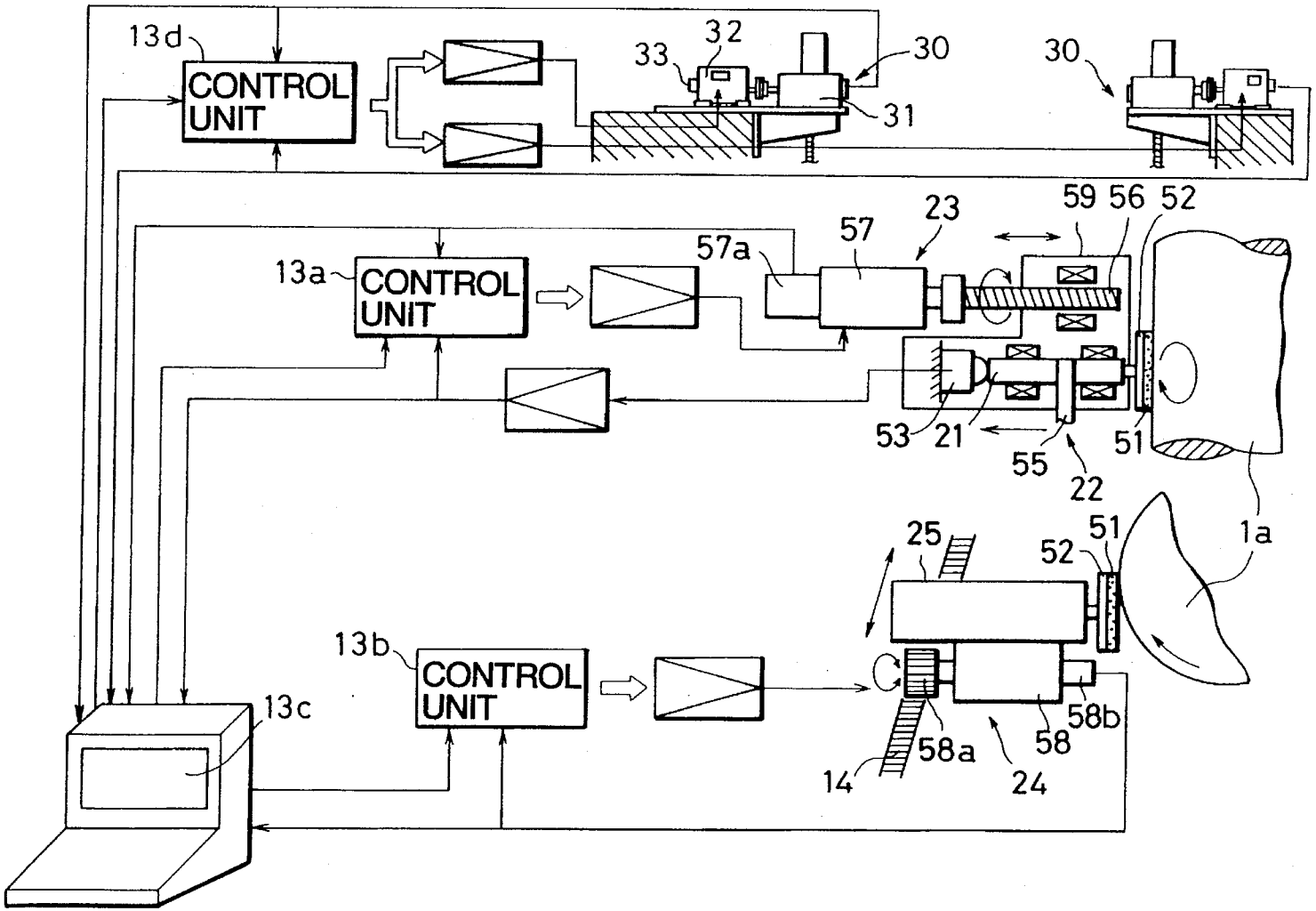
FIG. 6 is a diagram for explaining a control system of the on-line roll grinding apparatus.

As shown in FIG. 6, the shift motor 57 of the shifting device 23, the traverse motor 58 of the traversing device 24, and the motors 32 of the rail moving devices 30 are controlled by control units 13*a*, 13*b*, 13*d*, respectively. Also, detected signals from the load cell 53, the encoder 57*a* of the shifting device 23, the encoder 58*b* of the traversing device 24 and the encoders 33 associated with the motors of the rail moving devices 30 are transmitted to an information processing unit (computer) 13*c* and then processed.

In the above arrangement, the rail moving devices 30 make up rail moving means including the actuators (motors) 32 provided on the stands 4 and moving the rail frame 7 with respect to the stands 4 in the direction toward or away from the work roll 1*a*. Also, the information processing unit 13*c*, the control unit 13*d* and the encoder 33 make up means for controlling energization of the actuators 32 so that the direction of movement of the rail frame 7 is reversed between when the grinding unit 5 is positioned to grind one end side of the work roll 1*a* and when it is positioned to grind the other end side thereof.

The guides 9 make up guide means provided on the opposite stands 4 for supporting the rail frame 7 in a tiltable manner with respect to the stands 4. The rail moving devices 30, the information processing unit 13*c*, the control unit 13*d* and the encoder 33 make up rail position control means for controlling the rail frame 7 to be tilted in opposite directions with respect to the axis of the work roll between when the grinding unit 5 is positioned to grind one end side of the work roll and when it is positioned to grind the other end side thereof. Further, the information processing unit 13*c*, the control units 13*a*, 13*b* and the encoders 57*a*, 58*b* make up wheel position control means for keeping the direction of movement of the grinding wheel 20 parallel to the axis of the work roll 1*a* when the grinding unit 5 is moved along the rail frame 7.

Consequently, the rail moving devices 30, the information processing unit 13*c*, the control units 13*a*, 13*b*, 13*d*, the encoders 33, 57*a*, 58*b* and the guides 9 function as rail tilting means for changing a tilt of the rail frame 7 with respect to the stands 4 while keeping the direction of movement of the grinding wheel 20 parallel to the axis of the work roll 1*a* when the grinding unit 5 is moved along the rail frame 7. In connection with the above-described arrangement of the grinding wheel 20, the inclination of the spindle 21 with respect to the axis Rc of the work roll 1*a* is provided by the tilt of the rail frame 7.

The operation and control of the on-line roll grinding apparatus of this embodiment will now be described.

A description will first be made of the operation of the grinding wheel 20 in the on-line roll grinding apparatus of this embodiment.

The work roll 1*a* is rotated while vibrating at a frequency of 10 to 150 c/s depending on the rolling speed. When a roll grinder having a cylindrical grinding stone, which has been conventional in off-line grinding apparatus, is employed in on-line grinding apparatus, the cylindrical grinding stone and the work roll contact with each other through abrasives on the stone surface so that the work roll is ground by mutual collision of the roll on the roll surface and the abrasives.

Stated otherwise, the work roll is ground at the time the abrasives come into contact with the roll on the roll surface, but the grinding stone departs away from the work roll at a next moment, causing the abrasives to rotate while beating the air. With such discontinuous grinding, there occurs chattering to render the surface and section of the work roll irregular.

If a grinding wheel or stone is vibrated at the same frequency as that of the work roll, no changes are caused in the contact force between the grinding wheel and the work roll. Because of the work roll vibrating at a high frequency of 150 c/s, however, it is difficult to vibrate the grinding wheel, including its entire frame, in tune with the work roll. In view of the above, if the grinding wheel itself is given with an elastically deforming function to absorb the vibration through deflection thereof, rather than escaping the vibration through the grinding wheel and its entire frame, the movable mass is so reduced as to smoothly follow the vibration of the work roll, whereby fluctuations in the contact force between the grinding wheel and the work roll become small.

In this embodiment, such an elastically deforming function is imparted to the grinding wheel itself by causing the planar wheel disk 52 as a part of the grinding wheel 20 to have an elastically deforming function. More specifically, the grinding wheel 20 is deflected by being pressed against the rotating work roll 1*a*, while it is being rotated at a circumferential speed of 1000 m/min to 1600 m/min of the abrasive layer 51 measured at its outer periphery. During the grinding, the work roll 1*a* is vibrating back and forth, as explained above. The grinding wheel 20 is pushed by that vibration but, at this time, the planar wheel disk 52 is deflected, as shown in FIG. 5, to momentarily absorb the vibration transmitted from the work roll 1*a*. Accordingly, fluctuations in the contact force between the abrasive layer 51 and the work roll 1*a* are held down within a small extent of the elastic force produced upon the deflection of the planar wheel disk 52, thereby eliminating the occurrence of chattering marks.

In addition, for a cylindrical grinding stone, it is difficult to give the grinding stone itself with an elastically deforming function because the work roll and a spindle of the grinding stone are arranged in parallel to each other. For a planar type grinding wheel, however, an elastically deforming function can be easily imparted to the grinding wheel itself because the work roll and the spindle of the grinding wheel are arranged in substantially orthogonal relation. For this reason, using a planar type grinding wheel is more effective to grind the vibrating work roll.

Thus, in this embodiment, an elastically deforming function is imparted to the planar wheel disk 52 as a base of the abrasive layer 51. Also, to effectively develop the elastically deforming function, the grinding wheel 20 is arranged such that the contact line between the abrasive layer 51 and the work roll 1*a* is defined only in one side as viewed from the center of the grinding wheel, as shown in FIG. 5. This arrangement allows the planar wheel disk 52 to deflect in such cantilever fashion under the force pressing it against the work roll 1*a* as to absorb the vibration transmitted from the work roll 1*a*.

Furthermore, because of the abrasive layer 51 being annular in shape, even when the grinding wheel 20 is pressed against the work roll 1*a* in parallel thereto, the grinding wheel contacts the work roll at two points of the abrasive layer 51 on both sides of the wheel center and the plain wheel 52 can deflect. In this case, however, since the plain wheel 52 is supported at two opposite ends, it is less deflected. By contacting the plain wheel 52 with the work roll at one point as with this embodiment, a larger deflection can be obtained by using the same plain wheel 52.

A grinding wheel has an allowable range of the contact force between the work roll and the grinding wheel depending on the grinding ability of abrasives. In the case of imparting an elastically deforming function to the grinding wheel itself, the following condition must be satisfied in order that the contact force is properly held in the allowable range and the grinding wheel will not resonate under vibration of the work roll:

$$F \geqq K \times Amax$$

where

F: allowable range of the contact force

Amax: one-side amplitude of vibration of work roll

K: spring constant of elastic body (plain wheel)

Thus, $$K \leqq F/Amax.$$

Therefore, if an elastic body of the grinding wheel itself has a spring constant smaller than the above spring constant K determined from the allowable range F of the contact force between the grinding wheel and the work roll and the one-side amplitude Amax of vibration of the work roll, the grinding wheel can grind the work roll while following the latter at all times.

On the other hand, if the natural frequency of the grinding wheel coincides with the vibration frequency of the work roll, the grinding wheel is caused to resonate and hence can no longer grind the work roll precisely. For this reason, the natural frequency of the grinding wheel is preferably set to be as far as possible from the vibration frequency of the work roll.

$$Fn > Frmax$$

where

Fn: natural frequency of the grinding wheel

Frmax: maximum number of vibration frequency of the work roll

Meanwhile, the natural frequency of the grinding wheel is expressed by:

$$Fn = \frac{1}{2\pi} \sqrt{K/M}$$

where

M: mass of the grinding wheel including the elastic body (i.e., movable mass)

Accordingly, in an attempt to raise the natural frequency of the grinding wheel, it is required to increase the spring constant K of the elastic body, or reduce the mass M of the grinding wheel including the elastic body. But, as mentioned above, the spring constant K of the elastic body cannot be set larger than a certain value (F/Amax). To raise the natural frequency of the grinding wheel, therefore, the mass of the grinding wheel including the elastic body must be reduced.

On condition of F=4 Kgf and Amax=30 μm, for example, K=133 Kgf/mm is resulted. Assuming that there hold Frmax=150 c/s and Fn=400 c/s, therefore, the movable mass M including the grinding wheel must be held down to 0.2 Kg.

For the grinding wheel made of abrasive grains of aluminum oxide ($Al_2O_3$) or silicon carbide (SiC) which are generally used in grinding wheels or stones, if the movable mass is held down to 0.2 Kg, the grinding wheel would be soon worn away thoroughly and would had be exchanged many times per day. This greatly lessens the effect of grinding the work roll in the rolling mill, i.e., on-line.

To solve that problem, it is needed to use a grinding wheel with a high grinding ratio (the volume of the work reduced/the volume of the grinding wheel reduced).

When the grinding wheel is made of abrasive grains of aluminum oxide ($Al_2O_3$) or silicon carbide (SiC) which are generally used at the present, it is difficult to increase the grinding ratio more than 3 in the case of grinding a hard work roll. In contrast, the grinding wheel 20 of this embodiment, which is made of super abrasive grains such as cubic boron nitride (generally called CBN) abrasives or diamond abrasives, has a grinding ratio above 300 even in grinding the work roll 1*a*, which value is more than 100 times that of the grinding wheel made of aluminum oxide ($Al_2O_3$) abrasives or silicon carbide (SiC) abrasives. By employing the above super abrasive grains in the grinding wheel of the on-line roll grinding apparatus so as to advantageously utilize such a high grinding ratio of the super abrasive grains, the grinding can be continued for a long period of time with a small weight of the grinding wheel.

Further, in this embodiment, the abrasive layer 51 is attached to the base in the form of the planar wheel disk 52 and an elastically deforming function is imparted to the plain wheel 52, so that the abrasive layer 51 is integral with a member having the elastically deforming function. Therefore, only both the abrasive layer 51 and the planar wheel disk 52 provide the mass forced to move with the vibration from the work roll 1*a*. Consequently, the movable mass can be very small and the natural frequency of the grinding wheel 20 can be raised.

As mentioned above, with this embodiment, the abrasive layer 52 is formed of super abrasive grains having a high grinding ratio (which enable the grinding wheel to have a light weight and a long service life) for achieving the small movable mass, and the grinding wheel 20 with the integral planar wheel disk 52 having a proper spring constant is pressed against work roll 1*a* while it is rotating. As a result, it is possible to correctly grind the vibrating work roll for a long period of time without causing chattering marks due to resonance.

Further, the single grinding unit 5 is provided for one work roll 1*a* in this embodiment. In order to grind the entire length of the work roll 1*a* by the single grinding unit (i.e., one grinding wheel), the grinding ability of the one grinding wheel must be increased to such an extent as to exceed the grinding rate necessary for grinding the work roll to eliminate the periphery difference produced thereon. Since the above-described grinding wheel 20 has a high grinding ability with the arrangement that the spindle 21 is inclined to provide the contact line at one point between the grinding wheel and the work roll, it is possible to grind the work roll up to both ends by the single grinding unit 5.

Control of the on-line roll grinding apparatus of this embodiment will now be described.

Figure 7:
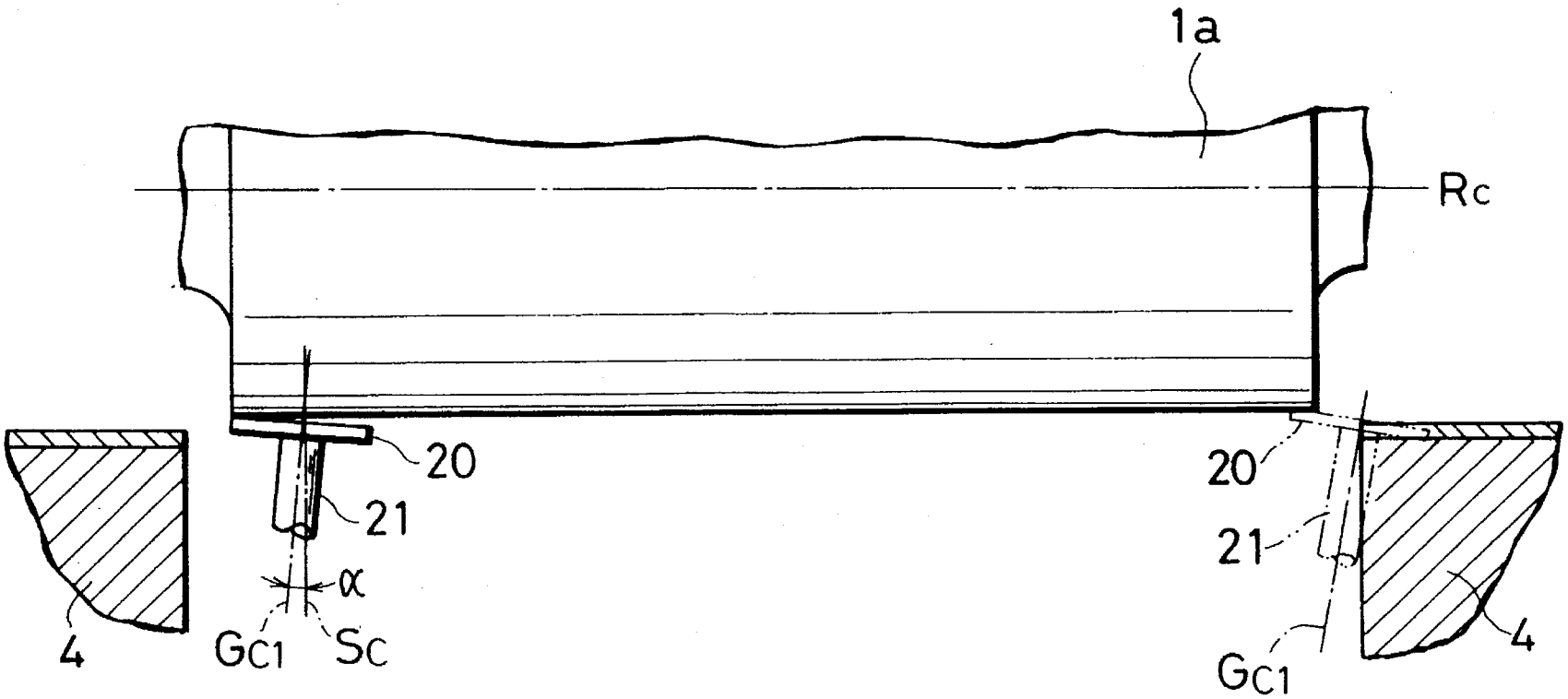
FIG. 7 is a representation showing interference between the grinding wheel and a stand in the case of grinding a work roll under a condition that a spindle of the grinding wheel is inclined relative to a line perpendicular to the roll axis.
Figure 8:
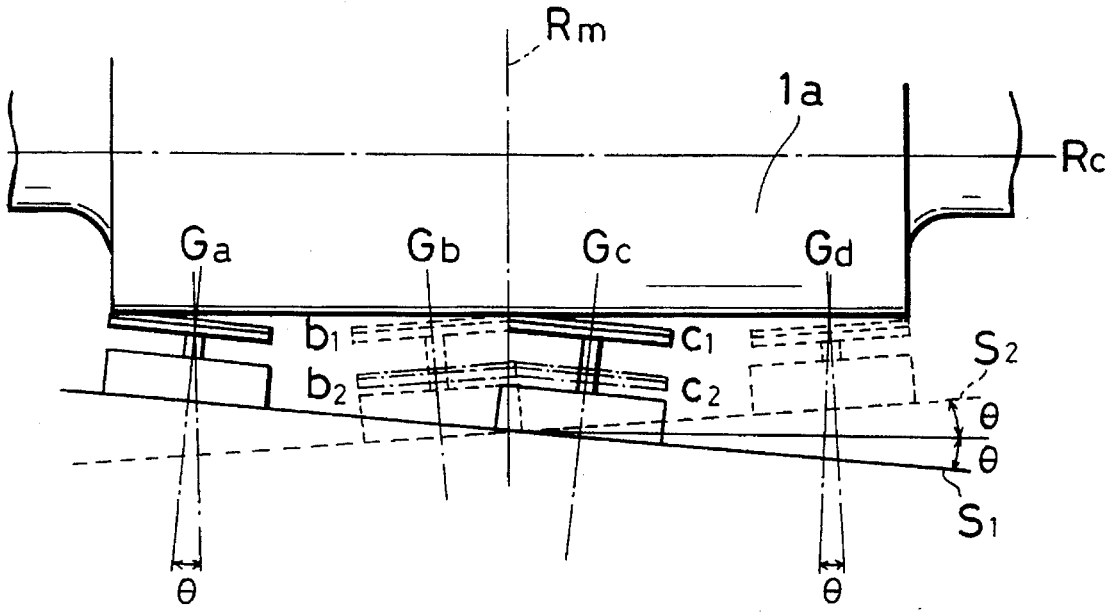
FIG. 8 is a representation for explaining the tilt of a rail frame and the movement and control of the grinding unit when both ends of the rail frame are moved.
Figure 9:
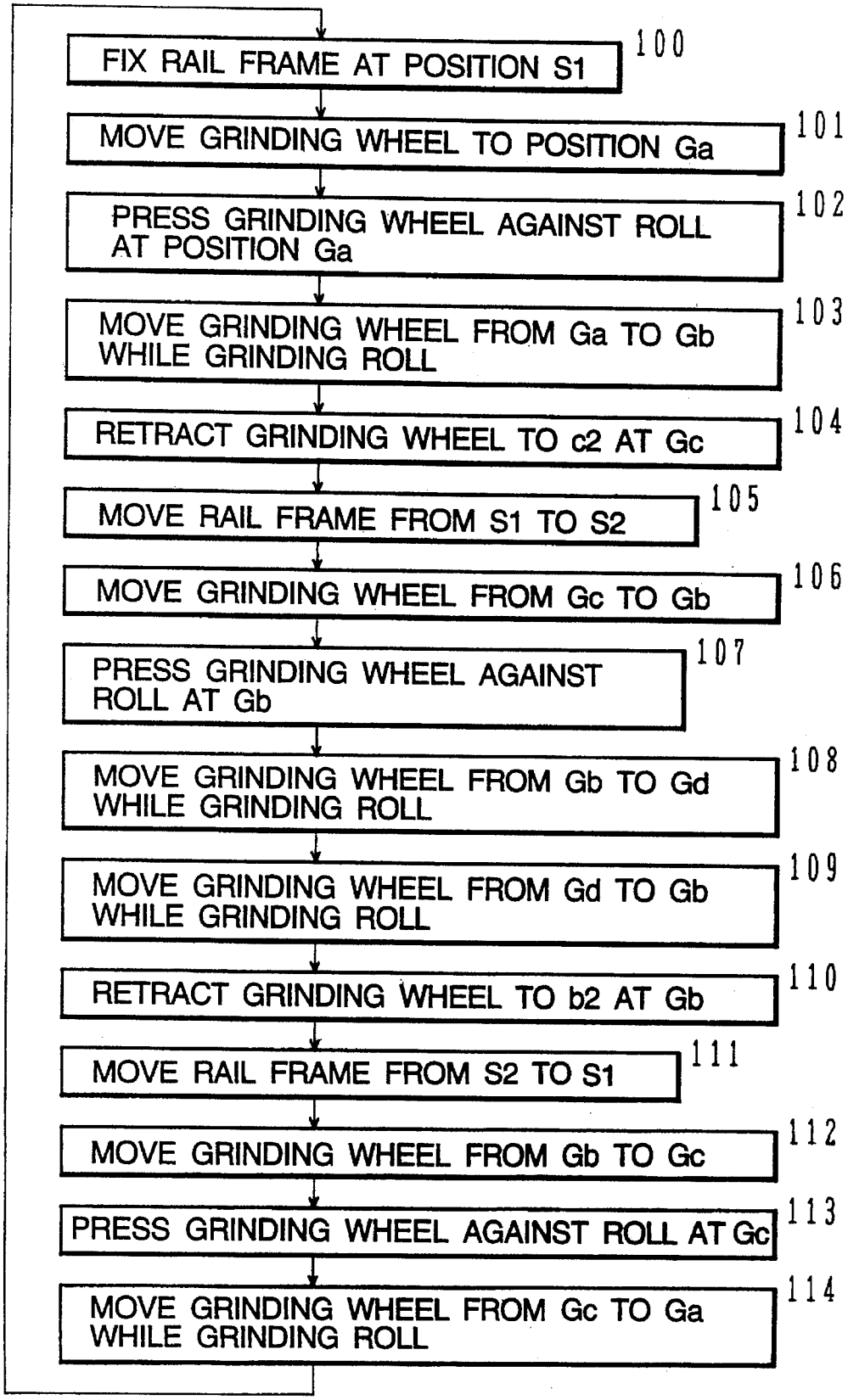
FIG. 9 is a flowchart showing procedures of the control shown in FIG. 8.

In this embodiment, as described above, the grinding is performed under a condition that the spindle 21 of the grinding wheel is inclined to provide the contact line at one point between the grinding wheel and the work roll. With such an inclined arrangement of the spindle 21, the grinding wheel can grind the work roll up to the roll end on the same side as the grinding surface (i.e., the contact line) without protruding out of the roll end, but its portion diametrically opposite to the grinding surface must be moved out of the roll end when grinding the work roll up to the other roll end. In the latter case, because the roll chock and the stand 4 are present outside the roll end as shown in FIG. 7, there arises a problem that the grinding wheel interferes with the stand, etc. and cannot grind the work roll up to the roll end. By reversing the inclination of the spindle 21 to change the grinding surface between when grinding one end side of the work roll and when grinding the other end side, the work roll can be ground up to both ends by one grinding wheel. However, if a tilting device for changing the inclination of the spindle 21 is provided, the grinding unit would be enlarged in its construction and, if a tilting device is provided on the grinding unit, the tilting device would interfere with the roll chock before the grinding wheel moves to the roll end.

In this embodiment, the rail frame 7 for supporting the grinding unit 5 is employed and the spindle 21 is inclined with respect to the axis of the work roll 1*a* by tilting the rail frame 7 with respect to the stands 4 by the rail tilting means which includes the rail moving devices 30. Also, by changing a tilt of the rail frame 7 with respect to the stands 4, the spindle 21 is reversed in its inclination so as to change the grinding surface of the grinding wheel. To this end, the rail moving devices 30, the wheel shifting device 23 and the wheel traversing device 24 are controlled as follows.

First, the positional relationship is previously set so that the axis of the grinding wheel spindle 21 of the grinding unit 5 is perpendicular to the axis Rc of the work roll 1*a* under a condition that the rail frame 7 is parallel to the work roll 1*a*. When grinding a left half of the work roll 1*a* in FIG. 8, the rail frame 7 is tilted by an angle of θ with respect to the work roll axis Rc using the rail moving devices 30 so that the rail frame is fixed to a position indicated by S1 and the left-hand side of the grinding wheel provides the grinding surface (Step 100). Here, θ is a small angle of approximately 0.5 degree. Then, the grinding unit 5 is moved through the meshing between the traverse motor 58 and the rack 14 and is stopped at the time the information processing unit 13*c* recognizes based on the information from the encoder 58*b* that the axis of the spindle 21 has moved to a position indicated by Ga (Step 101). The grinding wheel 20 is then pressed against the work roll 1*a* to start grinding (Step 102).

After start of the grinding, the grinding unit 5 is moved through the meshing between the traverse motor 58 and the rack 14 (Step 103) and, at the time the information processing unit 13*c* recognizes based on the information from the encoder 58*b* that the grinding surface of the grinding wheel 20 has moved to the center Rm of the work roll 1*a*, the grinding wheel 20 is retracted from a position c1 to a position c2 (Step 104). Then, the rail frame 7 is tilted using the rail moving devices 30 until it is reversely inclined by an angle of −θ with respect to the work roll axis Rc and takes a position S2 (Step 105). With such a change in the tilt of the rail frame 7, the grinding surface is now provided by the side of the grinding wheel opposite to that used in the above. The axis of the spindle 21 is moved back to a position Gb where the new grinding surface is positioned at the center Rm of the work roll 1*a* (Step 106). The grinding wheel 20 is advanced from a position b2 in the roll radial direction by the shifting device 23 to such a position as where the grinding wheel 20 is pressed against the work roll 1*a* to produce a required contact force (Step 107). The axis of the spindle 21 is then moved from the above position to a position Gd by the traversing device 24 (Step 108). Thereafter, in a reversed manner to the above, the axis of the spindle 21 is returned to the position Ga while the grinding wheel 20 is grinding the work roll 1*a* (Steps 109 to 114).

In the above operation, during the grinding in which the grinding unit 5 is moving over the rail frame 7 (Steps 103, 108, 109 and 114), the distance between the work roll 1*a* and the grinding wheel 20 is always changed because of the rail frame 7 being tilted and, therefore, the spindle 21 is moved back and forth by the shifting device 23 so that the required contact force is produced between the grinding wheel 20 and the work roll 1*a*. Alternatively, the rail frame 7 may be moved back and forth in a small amount. Such an arrangement enables the grinding to be performed in the same manner as when the rail frame 7 is parallel to the work roll 1*a*.

Figure 10:
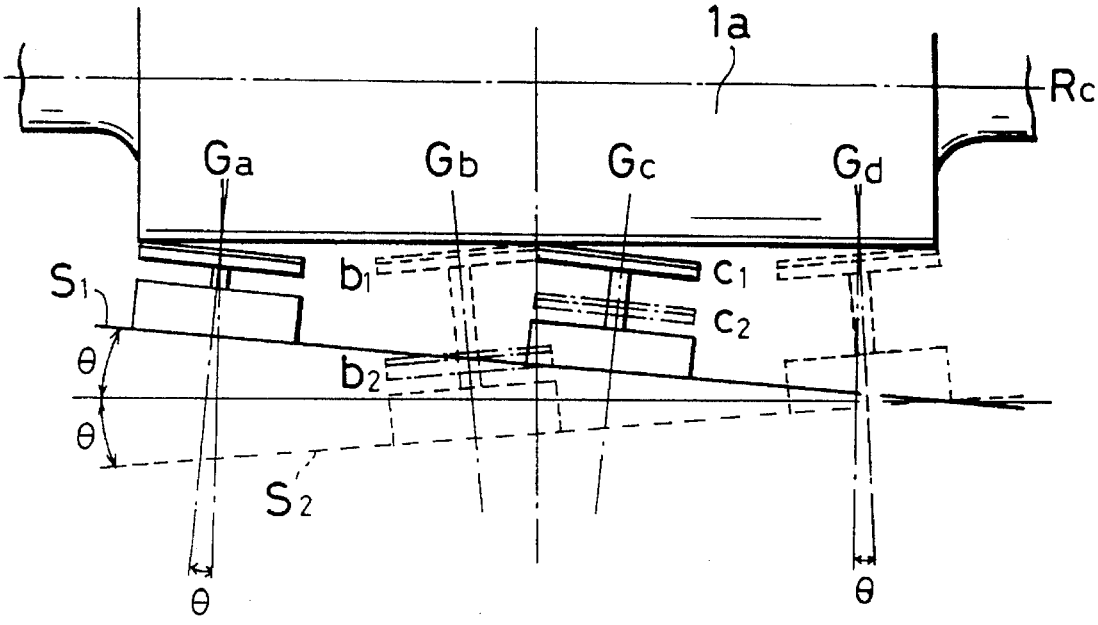
FIG. 10 is a representation for explaining the tilt of the rail frame and the movement and control of the grinding unit when the rail frame is rotatably supported at one end and is moved at the other end.

FIG. 10 shows another control method adapted for the structure wherein one end of the rail frame 7 is rotatably attached and the other end thereof is movable back and forth by the rail moving device 30. The grinding is performed by moving the rail frame 7 so that its tilt angle becomes θ and −θ with respect to the work roll axis Rc respectively when the grinding area of the grinding wheel 20 is on the right- and left-hand sides. Since the tilt angle of the rail frame 7 is as small as approximately 0.5 degree, the difference in distance between the rail frame 7 and the work roll 1*a* can be compensated for with the shift of the spindle 21 by the wheel shifting device 23, and the rotating wheel 20 can be traversed while producing the predetermined contact force with respect to the work roll 1*a*.

While the above description is made of the grinding of the work roll 1*a*, it is a matter of course that the reinforcing roll 1*b* can also be ground in a like manner.

Further, the illustrated embodiment employs the worm screw 31 for moving the rail frame 7. However, the similar control to the above can be effected by using, instead of the worm screw 31, a combination of two large- and small-stroke hydraulic cylinders, actuating the large-stroke cylinder when the rolls are to be replaced, and actuating the small-stroke cylinder in the control of the present invention in which the rail frame 7 is tilted.

A second embodiment of the present invention will be described below with reference to FIGS. 11 to 16. This embodiment is intended to grind work rolls following the cross angle in a roll crossing mill in which the work rolls are horizontally moved in opposite directions with respect to a direction perpendicular to the rolling direction. Note that identical members in FIGS. 11 to 16 to those in the first embodiment are denoted by the same reference numerals.

Figure 11:
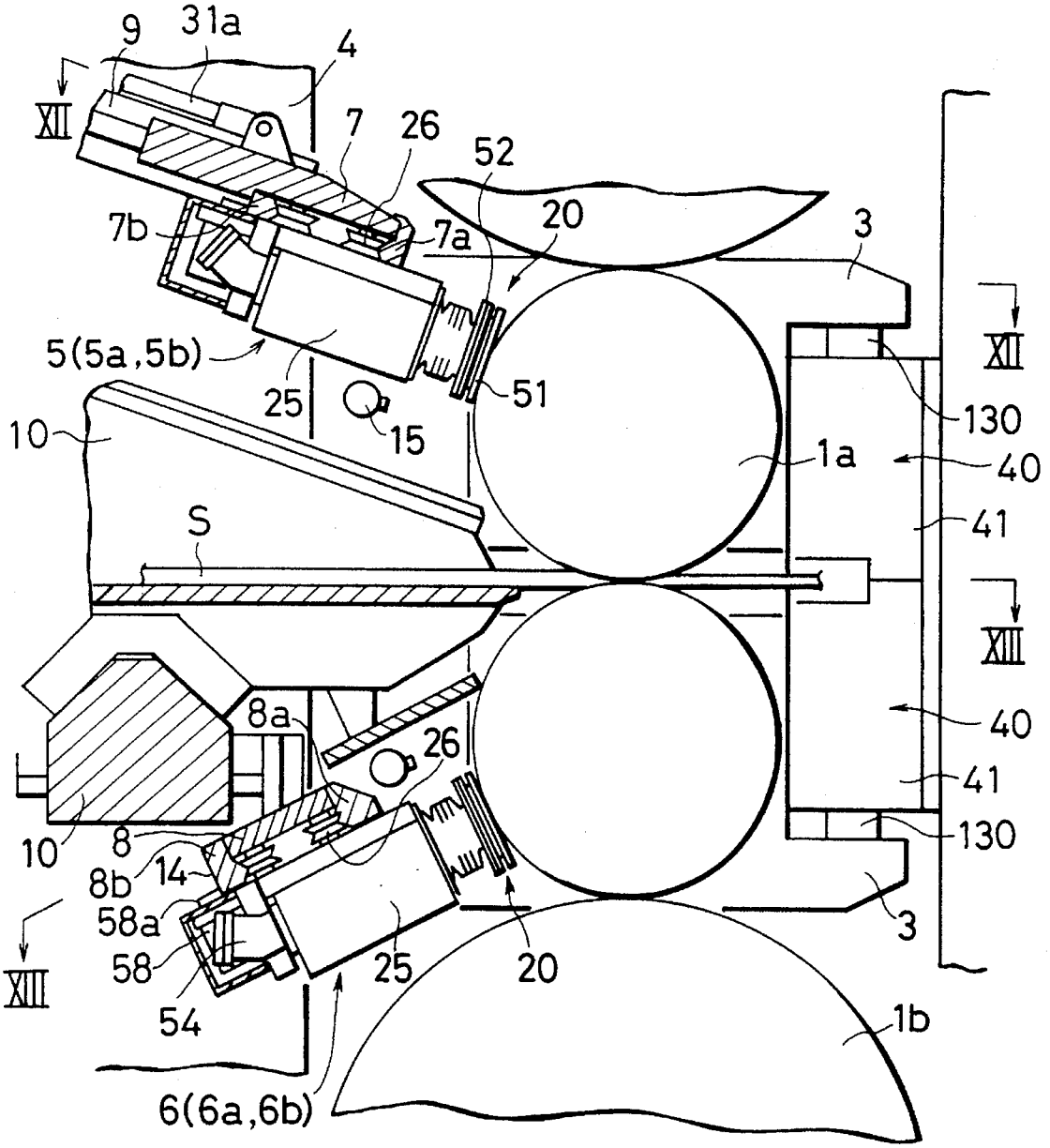
FIG. 11 is a side view, partially sectioned, of principal parts of a rolling mill equipped with an on-line roll grinding apparatus according to another embodiment of the present invention.
Figure 12:
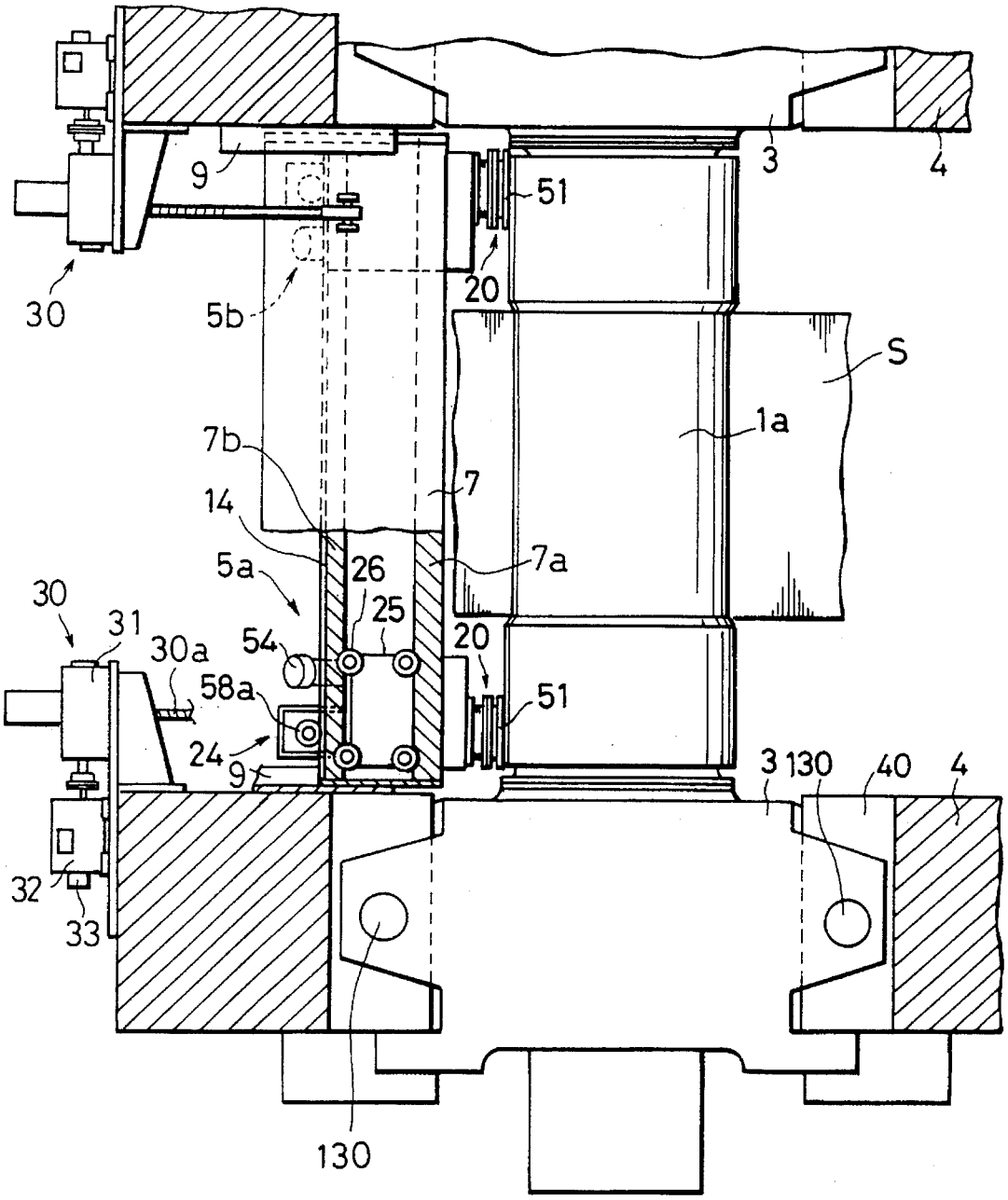
FIG. 12 is a sectional view taken along line XII—XII in FIG. 11.
Figure 13:
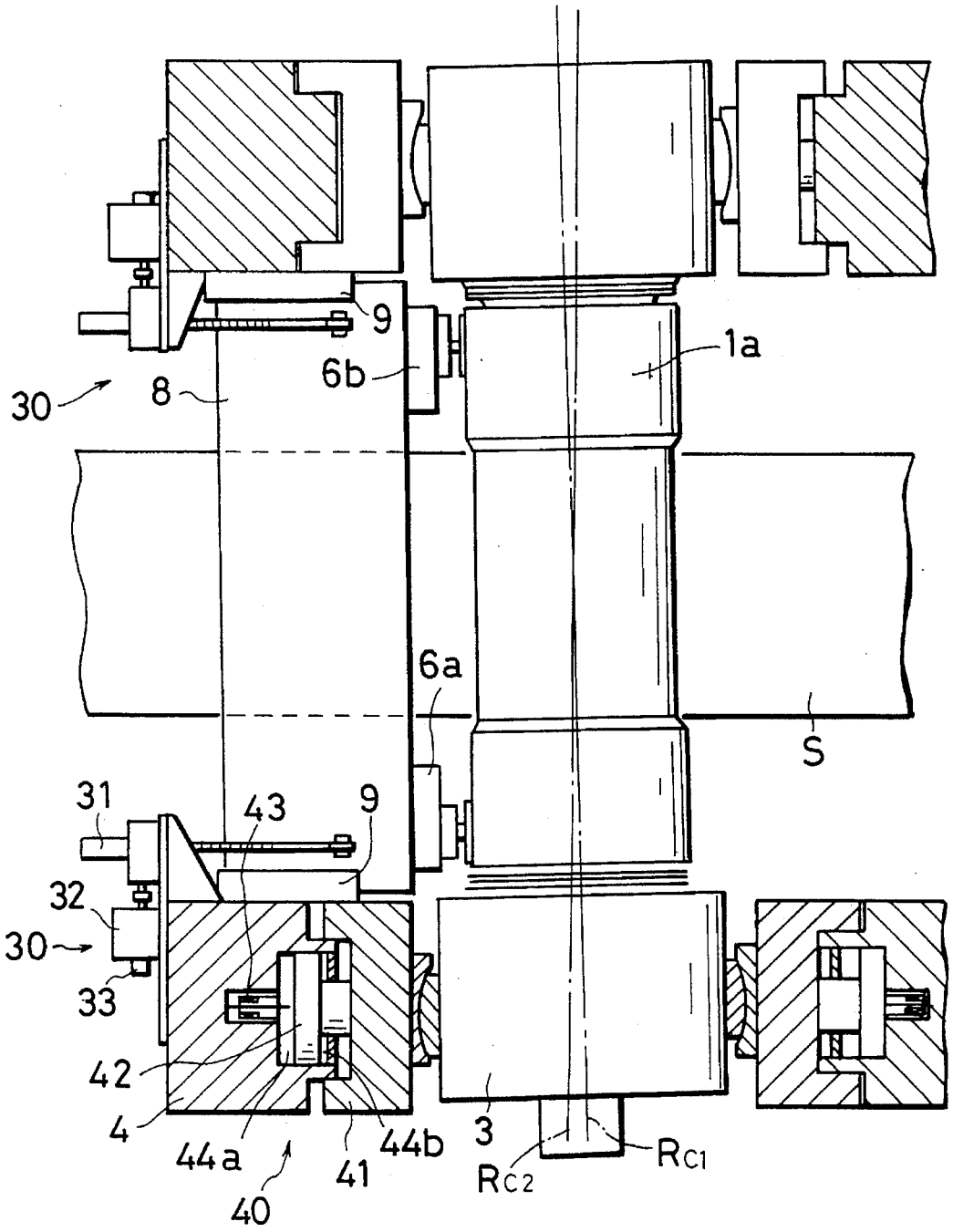
FIG. 13 is a sectional view taken along line XIII—XIII in FIG. 11.

Referring to FIGS. 11 to 13, a rolling mill of this embodiment is of a 4-high rolling mill comprising a pair of rolls (upper and lower work rolls) 1*a*, 1*a* for rolling a strip S, a pair of rolls (upper and lower backup rolls) 1*b*, 1*b* for respectively supporting the work rolls 1*a*, 1*a*, and a pair of roll benders 130, 130 for respectively deflecting the work rolls 1*a*, 1*a*, and crossing devices 40, 40 for crossing the work rolls 1*a*, 1*a* horizontally.

The on-line roll grinding apparatus of this embodiment comprises two upper grinding units 5*a*, 5*b* (hereinafter represented by "5" in the description common to 5*a* and 5*b*) for the upper work roll 1*a* and two lower grinding units 6*a*, 6*b* (hereinafter similarly represented by "6") for the upper work roll 1*a*.

The upper grinding units 5*a*, 5*b* are disposed corresponding to the operating and driving sides of the work roll 1*a*, respectively, and can be operated to grind the work roll independently of each other. Likewise, the lower grinding units 6*a*, 6*b* are disposed corresponding to the operating and driving sides of the work roll 1*a*, respectively, and can be operated to grind the work roll independently of each other. Each of these grinding units 5*a*, 5*b*, 6*a*, 6*b* is of the same structure as the grinding unit 5 described above in connection with the first embodiment, and comprises, as shown in FIGS. 3 to 5, a plain type grinding wheel 20 for grinding the work roll 1*a*, a driving device 22 for rotating the grinding wheel 20 through a spindle 21, a shifting device 23 for pressing the grinding wheel 20 against the work roll 1*a*, and a traversing device 24 for moving the grinding wheel 20 in the axial direction of the work roll 1*a*.

Figure 14:
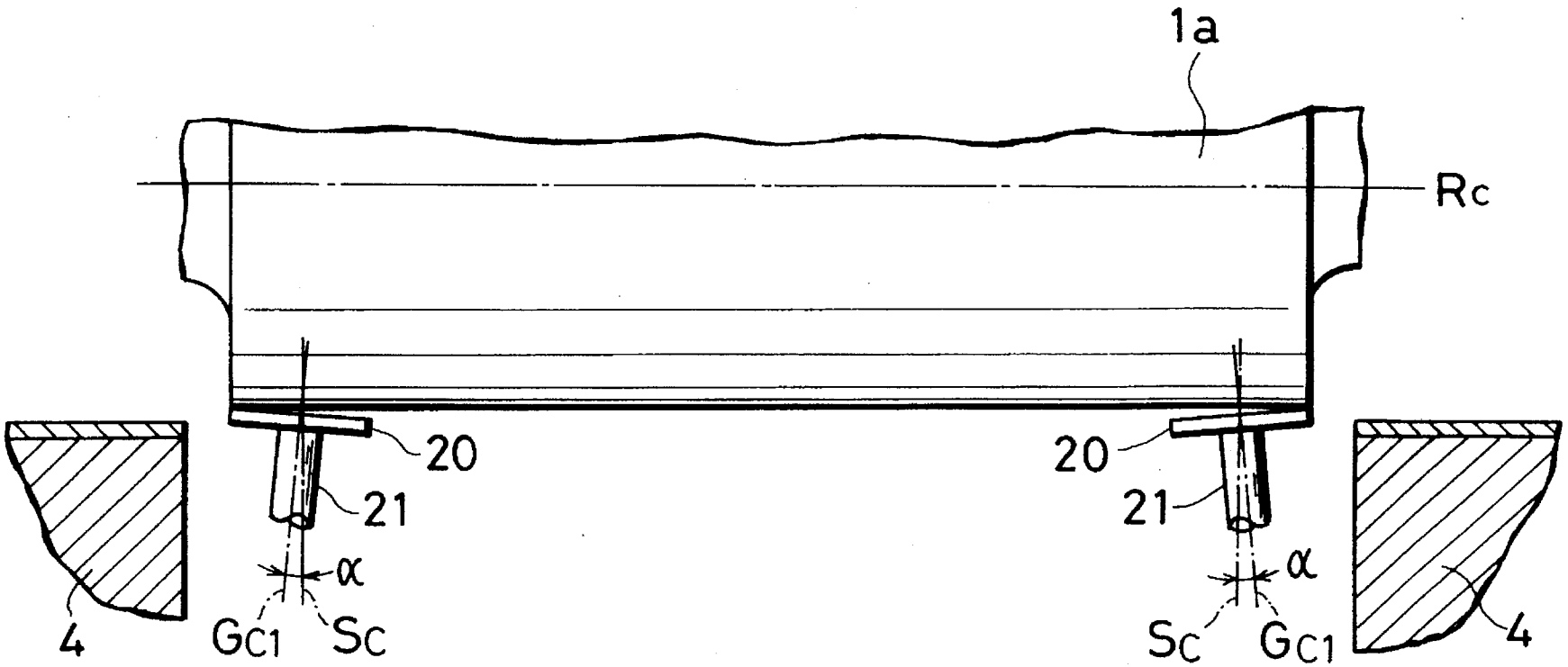
FIG. 14 is a representation showing the positional relationship between grinding wheels of two grinding units.

Also, the grinding wheel 20 of the grinding unit 5*a* and the grinding wheel 20 of the grinding unit 5*b* are arranged, as shown in FIG. 14, such that respective axes Gc1 of their spindles 21 are inclined by a small angle of α in opposite directions relative to respective lines Sc perpendicular to the axis Rc of the work roll 1*a*, and respective contact lines between abrasive layers 51 and the work roll 1*a* are each defined only in one corresponding roll end side as viewed from the center of the grinding wheel. Such an arrangement equally applies to the grinding wheel 20 of the grinding unit 6*a* and the grinding wheel 20 of the grinding unit 6*b*. This enables the grinding to be carried out to the opposite ends of the work roll 1*a* without interfering with stands 4.

The roll grinding units 5, 6 are required to be out of interference with the roll chocks 3 when the work rolls 1*a*, 1*a* are exchanged. To this end, rail frames 7, 8 including rails 7*a*, 7*b*; 8*a*, 8*b* are slidably supported at their both ends on guides 9 attached to the stands 4, so that the grinding units 5, 6 are movable with the rail frames 7, 8 in the direction toward or away from the work rolls 1*a*, 1*a* by rail moving devices 30 provided respectively on the operating and driving sides at both ends of each of the rail frames 7, 8. The rail moving devices 30 each comprise a worm screw 31, a motor 32 for driving the screw 31, and an encoder 33 associated with the motor 32. A screw shaft 31*a* of the worm screw 31 is pin-coupled at its distal end to the rail frame 7 or 8.

The crossing devices 40 each comprise, as shown in FIG. 13, a cross block 41 held in abutment with the roll chock 3 for pressing it, a piston 42 for moving the cross block 41 back and forth, a displacement meter 43 for measuring a displacement of the piston 42, a hydraulic chamber 44*a* for pushing the piston 42, and a hydraulic chamber 44*b* for returning the piston 42.

Figure 15:
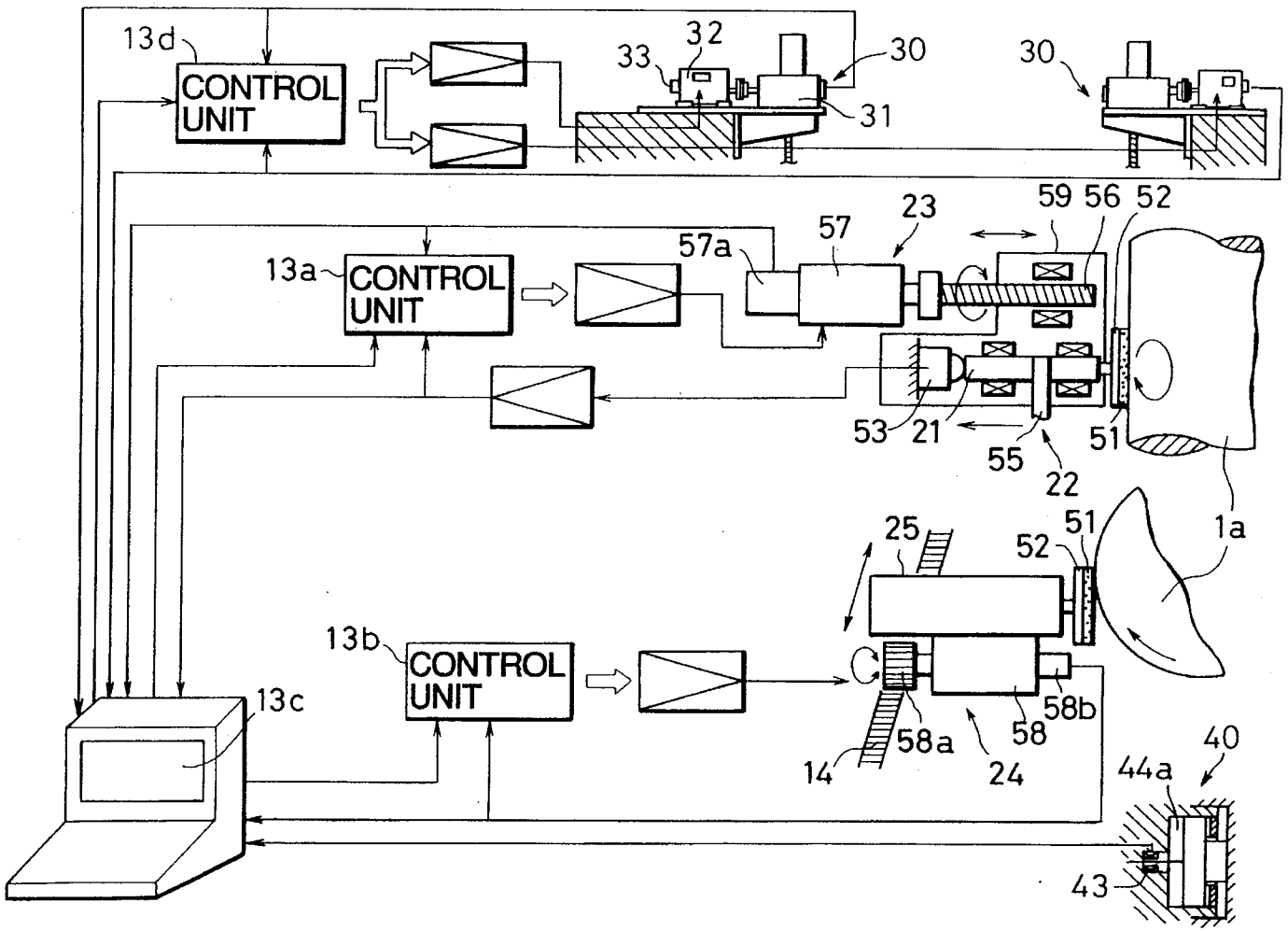
FIG. 15 is a diagram for explaining a control system of the on-line roll grinding apparatus.

As shown in FIG. 15, a shift motor 57 of the shifting device 23, a traverse motor 58 of the traversing device 24, and motors 32 of the rail moving devices 30 are controlled by control units 13*a*, 13*b*, 13*d*, respectively. Also, detected signals from a load cell 53, an encoder 57*a* of the shifting device 23, an encoder 58*b* of the traversing device 24, the encoders 33 associated with the motors of the rail moving devices 30, and the displacement meter 43 of the crossing device 40 are transmitted to an information processing unit (computer) 13*c* and then processed.

In the above arrangement, the rail moving devices 30 make up rail moving means including the actuators (motors) 32 provided on the stands 4 and moving the rail frames 7, 8 with respect to the stands 4 in the direction toward or away from the corresponding work rolls 1*a*, 1*a*. Also, the information processing unit 13*c*, the control units 13*a*, 13*b*, 13*d*, the encoders 33, 57*a*, 58*b* and the displacement meters 43 make up means for controlling energization of the actuators 32 based on the information about the cross angle of the work rolls so that the rail frames 7, 8 are kept parallel to the axes of the corresponding work rolls.

The guides 9 make up guide means provided on the opposite stands 4 for supporting the rail frames 7, 8 in a tiltable manner with respect to the stands 4. The rail moving devices 30, the information processing unit 13*c*, the control units 13*a*, 13*b*, 13*d*, the encoders 33, 57*a*, 58*b* and the displacement meters 43 make up rail position control means for controlling the rail frames 7, 8 to be tilted with respect to the stands 4 following the cross angle of the work rolls so that the rail frames 7, 8 are kept parallel to the axes of the corresponding work rolls 1*a*, 1*a*.

Consequently, the guides 9, the rail moving devices 30, the information processing unit 13*c*, the control units 13*a*, 13*b*, 13*d*, the encoders 33, 57*a*, 58*b* and the displacement meters 43 function as rail tilting means for changing the tilts of the rail frames 7, 8 with respect to the stands 4 while keeping the direction of movement of the grinding wheels 20 parallel to the axes of the corresponding work rolls when the grinding units 5*a*, 5*b*; 6*a*, 6*b* are moved along the rail frames 7, 8.

Figure 16:
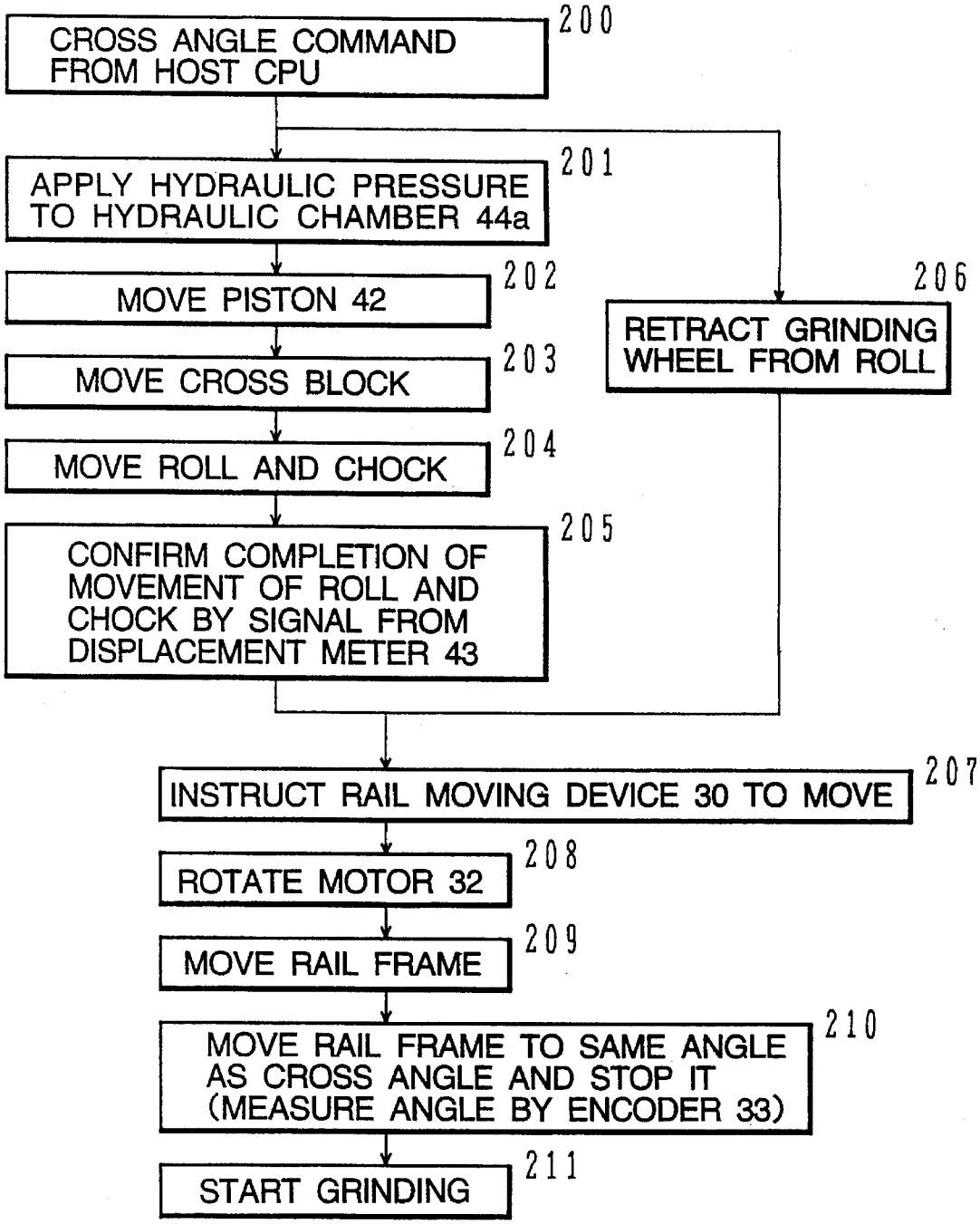
FIG. 16 is a flowchart showing procedures for the control of grinding to follow the cross angle.

The operation of the on-line roll grinding apparatus of this embodiment will be described below with reference to FIG. 16.

First, when a command of changing the cross angle of the work rolls is issued from a not-shown host computer (Step 200), a hydraulic pressure is applied to the hydraulic chamber 44*a* of each crossing device 40 to move the roll chock 3 through the cross block 41 in accordance with the command (Steps 201 to 204). The work roll axis is moved from Rc1 to Rc2, this movement being confirmed by the signals from the displacement meters 43 (Step 205). In response to the command, the grinding units 5 are retracted before moving the work roll axis (Step 206). After the movement of the work roll axis, the rail moving devices 30 are instructed to move (Step 207). The motors 32 are rotated (Step 208), and each rail frame 7, 8 is moved to be parallel to the work roll axis Rc2 (Step 209). At this time, whether the rail frame 7, 8 is parallel to the work roll axis Rc2 or not is confirmed by the information processing unit 13*c* based on measured values from the displacement meters 43 of the crossing devices 40 and the motor encoders 33 of the rail moving devices 30. When the parallel relation is confirmed, the movement of the rail frame is stopped (Step 210).

By moving the rail frames 7, 8 to be parallel to the corresponding work roll axes as described above, the grinding units 5, 6 can be controlled to grind the work rolls as with roll non-crossing mills.

Figure 17:
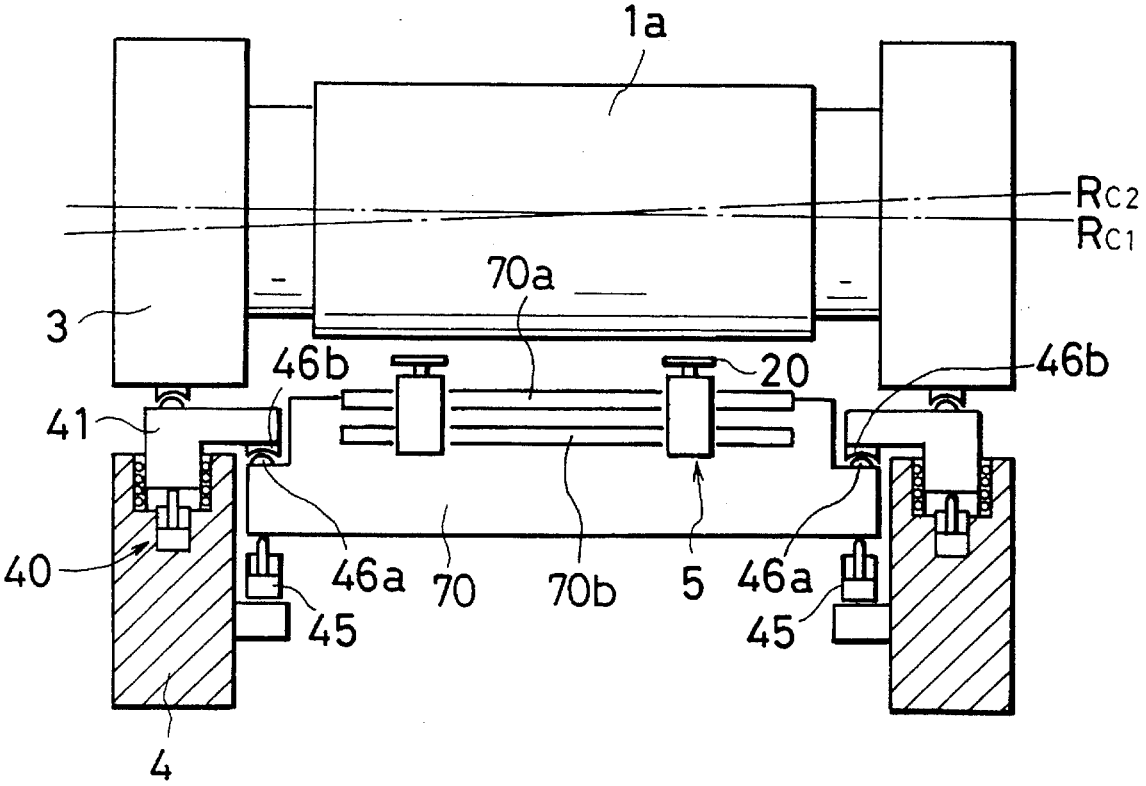
FIG. 17 is a schematic view of an embodiment in which the rail frame is held in contact with cross blocks and the tilt of the rail frame is controlled following the roll.

Another embodiment for moving the rail frames to follow the cross angle of the work rolls in a roll crossing mill will now be described with reference to FIG. 17. In this embodiment, a rail frame 70 is held in abutment with the cross blocks 40 so that the rail frame 70 is moved upon change in the cross angle.

More specifically, in accordance with a command from a not-shown host controller, the crossing devices 40 are controlled to move the cross blocks 41 in a like manner to the above. Both ends of the rail frame 70 including rails 70*a*, 70*b* are held in abutment with the cross blocks 41 through spherical supports 46*a*, 46*b*, and are also pressed by cross following cylinders 45 against the cross blocks 41 so that the rail frame 70 is moved following the cross blocks 41. Such an arrangement enables the rail frame 70 to be surely moved horizontally in the same amount as that through which each cross block 41 has moved. Thus, if no clearances exist between the spherical supports 46*a*, 46*b*, the rail frame 70 is always kept parallel to the work roll axis Rc. Another rail frame 80 is similarly arranged.

A third embodiment of the present invention will now be described with reference to FIGS. 18 and 19. This embodiment is intended to set the inclination of the grinding wheel spindle or the parallelism between the rail frame axed the work roll with high accuracy by providing stopper means and screws in the rail moving means in the above first and second embodiments.

Figure 18:
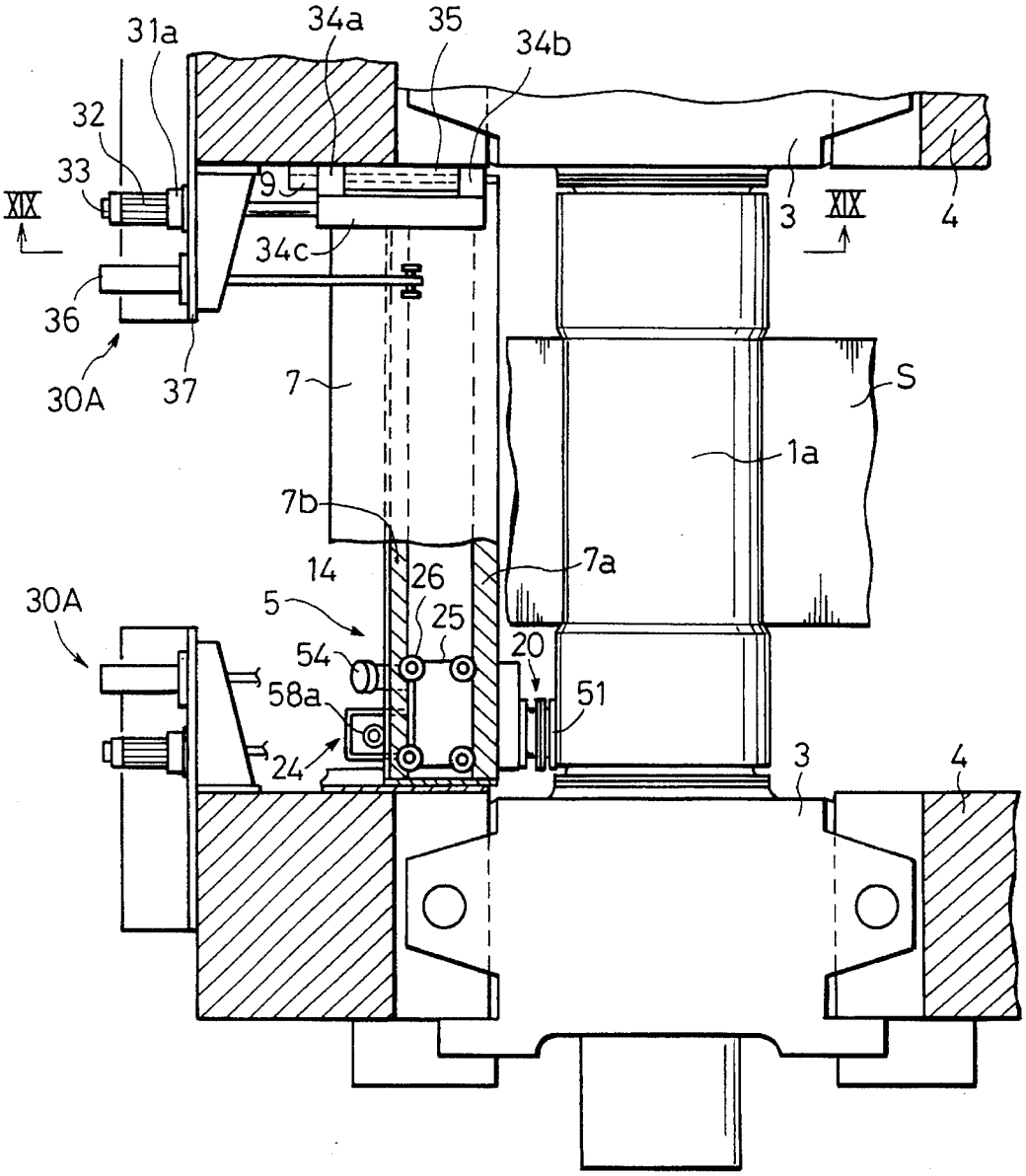
FIG. 18 is a plan view, partially sectioned, of principal parts of a rolling mill equipped with an on-line roll grinding apparatus according to a third embodiment of the present invention.
Figure 19:
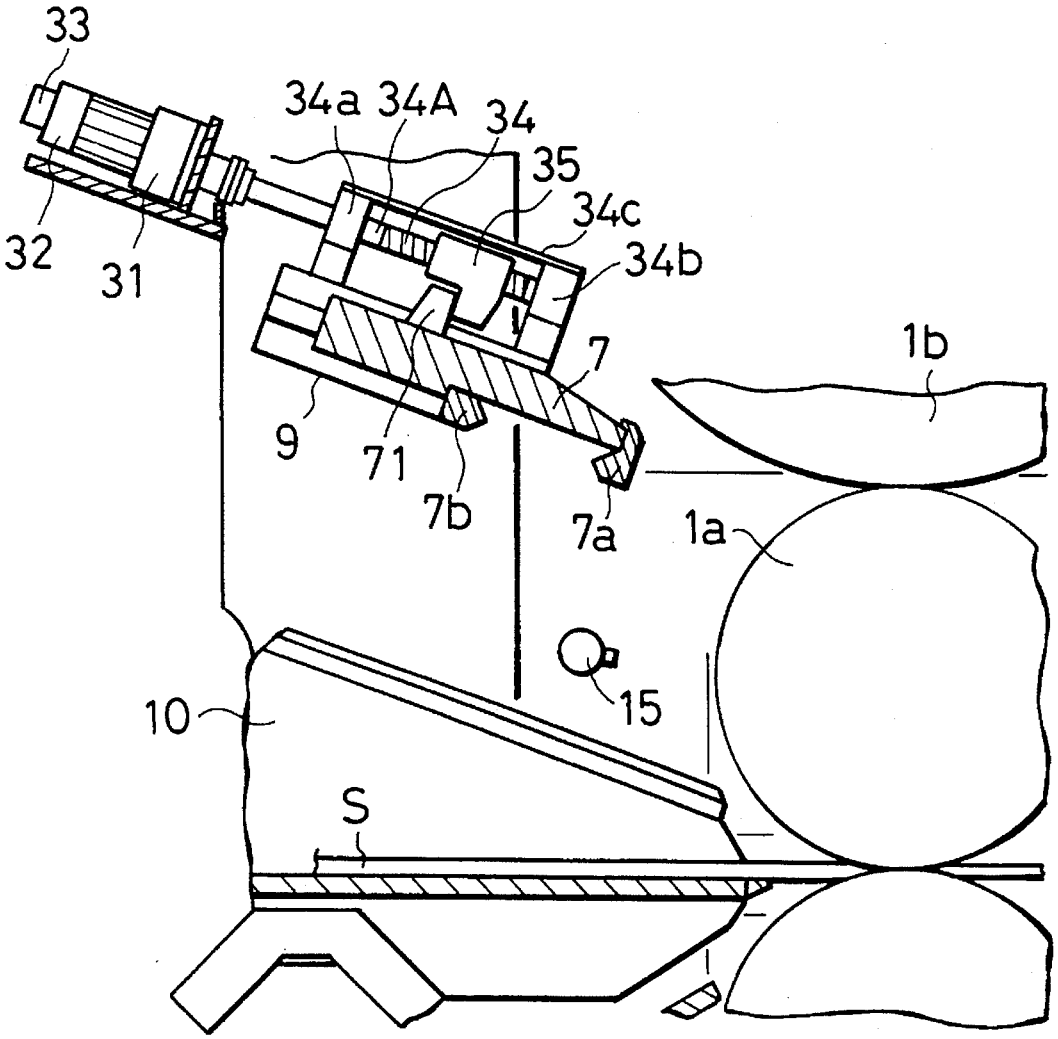
FIG. 19 is a sectional view taken along line XIX—XIX in FIG. 18.

Referring to FIG. 18, a rail moving device 30A comprises a mechanical stopper 35, a screw shaft 34A with a screw 34 for moving the mechanical stopper 35, a motor 32 for rotating the screw shaft 34A, a speed reducer 31 for transmitting the rotation of the motor 32 to the screw shaft 34A after reducing a rotational speed thereof, an encoder 33 for detecting the rotation of the motor 32, a stopper 71 provided integrally on an upper surface of the rail frame 7 to be held in abutment with the mechanical stopper 35 for positioning the rail frame 7, and a hydraulic cylinder 36 pin-coupled to the rail frame 7 for urging the rail frame 7 toward the work roll 1*a* under a predetermined force. The screw shaft 34A is rotatably supported through bearings by brackets 34*a*, 34*b* integrally fixed to the guide 9, and an anti-rotation plate 34*c* for preventing the rotation of the mechanical stopper 35 provided to extend between upper ends of the brackets 34*a*, 34*b*. The speed reducer 31, the motor 32 and the hydraulic cylinder 36 are fixedly supported by a support plate secured to the stand 4.

During roll grinding by the roll grinding unit 5, a high pressure is introduced to the hydraulic cylinder 36 to press the stopper 71 against the mechanical stopper 35 under a relatively large force so that the rail frame 7 is positioned and the grinding unit 5 is prevented from retracting due to the grinding reaction. At this time, the tilt of the rail frame 7 is held by the mechanical stopper 35 with high accuracy. When changing the tilt of the rail frame 7, the pressure of a hydraulic fluid introduced to the hydraulic cylinder 36 is reduced to make smaller the pressing force of the stopper 71 against the mechanical stopper 35. By rotating the motor 32 in this condition, the mechanical stopper 35 is moved back and forth with the rotation of the screw 34, causing the rail frame 7 to be advanced or retracted with the mechanical stopper 35 and the stopper 71 kept in an engaged state. Therefore, the tilt of the rail frame 7 can be changed to any desired angle by controlling the amount and direction of rotation of the motor 32 of the rail moving device 30A on each of the operating and driving sides. At this time, since the rail frame 7 is moved by rotating the screw 34 while keeping the mechanical stopper 35 and the stopper 71 in an engaged state, the rail frame 7 can be positioned with high accuracy. Consequently, when this embodiment is applied to the first embodiment, the inclination of the grinding wheel spindle 21 can be set with high accuracy and the grinding wheel 20 can be stably controlled. Also, when applied to the second embodiment, the parallelism between the rail frame 7 and the work roll 1*a* can be held under high precision following change in the cross angle.

When replacing the work rolls, the hydraulic fluid is reversely supplied to the hydraulic cylinder 36, whereupon the hydraulic cylinder 36 is contracted to move the rail frame 7 back so that the rail frame 7 is prevented from interfering with the roll chocks.

While the screw shaft 34A is rotated with the rotation of the motor 32 in this embodiment, the similar advantage can also be obtained by providing a mechanism which moves a rod back and forth with the rotation of the motor 32 and arranging the mechanical stopper 35 on the rod.

According to the present invention, as fully described above, since the vibration of a roll is absorbed by an elastically deforming function of the plain wheel of the grinding wheel, the roll can be precisely ground with high surface roughness without causing any chattering marks and resonance.

Also, since one work roll can be ground from one end to the other end by a single grinding unit, an on-line roll grinding apparatus can be equipped on a rolling mill with a smaller space and a reduced installation cost, by making effective use of the ability of the grinding apparatus.

Further, since rolls of a roll crossing mill can be easily ground by the grinding units following the cross angle of the rolls just by moving the rail frames, it is possible to grind each roll without causing a periphery difference between a strip passing area and a strip not-passing area of the roll, and hence to realize completely schedule-free rolling in roll crossing mills.

What is claimed is:

1. An on-line roll grinding apparatus equipped on a rolling mill including at least one pair of rolls rotatably supported between opposite stands, said apparatus comprising a single grinding unit provided for at least one roll and a rail frame for supporting said grinding unit movably in an axial direction of said roll, said grinding unit comprising a planar type grinding wheel for grinding said roll, driving means for rotating said grinding wheel through a spindle, shifting means for pressing said grinding wheel against said roll, and traversing means for moving said grinding unit along said rail frame, wherein;

said grinding wheel comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll; and said apparatus further comprises rail tilting means for changing a tilt of said rail frame with respect to said stands while keeping the direction of movement of said grinding wheel parallel to the axis of said roll when said grinding unit is moved along said rail frame.

2. An on-line roll grinding apparatus according to claim 1, wherein salad rail tilting means comprises guide means provided on said opposite stands for supporting said rail frame tiltably with respect to said stands, rail position control means for controlling said rail frame to be tilted in opposite directions with respect to the axis of said roll between when said grinding unit is positioned to grind one end side of said roll and when said grinding unit is positioned to grind the other end side of said roll, and wheel position control means for keeping the direction of movement of said grinding wheel parallel to the axis of said roll when said grinding unit is moved along said rail frame.

3. An on-line roll grinding apparatus according to claim 2, wherein said rail position control means comprises rail moving means including an actuator provided on at least one of said stands and moving said rail frame with respect to said stands in the direction toward or away from said roll, and means for controlling energization of said actuator so that the direction of movement of said rail frame is reversed between when said grinding unit is positioned to grind one end side of said roll and when said grinding unit is positioned to grind the other end side of said roll.

4. An on-line roll grinding apparatus according to claim 3, wherein said rail moving means further comprises stopper means for positioning said rail frame when said rail frame is moved by said actuator in the direction toward or away from said roll.

5. An on-line roll grinding apparatus according to claim 3, wherein said rail moving means further comprises a screw rotated by said actuator, a stopper movable in the direction toward or away from said roll with the rotation of said screw, and urging means for holding said rail frame in abutment with said stopper.

6. An on-line roll grinding apparatus according to claim 2, wherein said wheel position control means is means for driving said shifting means and said traversing means so that said grinding wheel is moved parallel to the axis of said roll regardless of change in the distance between said rail frame and the axis of said roll due to the tilt of said rail frame.

7. An on-line roll grinding apparatus according to claim 1, wherein said abrasive layer includes cubic boron nitride abrasives or diamond abrasives.

8. An on-line roll grinding apparatus equipped on a roll crossing mill in which at least one pair of rolls rotatably supported between opposite stands are crossed horizontally for rolling strips, said apparatus comprising at least two grinding units provided for at least one roll and a rail frame for supporting said grinding units movably in an axial direction of said roll, each of said grinding units comprising a planar type grinding wheel for grinding said roll, driving means for rotating said grinding wheel through a spindle, shifting means for pressing said grinding wheel against said roll, and traversing means for moving said grinding unit along said rail frame wherein, said grinding wheel comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll; and said apparatus further comprises tail tilting means for changing a tilt of said rail frame with respect to said stands while keeping the direction of movement of said grinding wheel parallel to the axis of said roll when said grinding unit is moved along said rail frame.

9. An on-line roll grinding apparatus according to claim 8, wherein said rail tilting means is follow-up moving means for moving said rail frame following a cross angle of said rolls so that said rail frame is kept parallel to the axis of corresponding one of said rolls.

10. An on-line roll grinding apparatus according to claim 8, wherein said rail tilting means comprises guide means provided on said opposite stands for supporting said rail frame tiltably with respect to said stands, and rail position control means for controlling said rail frame to be tilted with respect to said stands following a cross angle of said rolls so that said rail frame is kept parallel to the axis of corresponding one of said rolls.

11. An on-line roll grinding apparatus according to claim 10, wherein said rail position control means comprises rail moving means including an actuator provided on at least one of said stands and moving said rail frame with respect to said stands in the direction toward or away from said roll, and means for controlling energization of said actuator based on information about the cross angle of said rolls so that said rail frame is kept parallel to the axis of corresponding one of said rolls.

12. An on-line roll grinding apparatus according to claim 10, wherein said rail moving means further comprises stopper means for positioning said rail frame when said rail frame is moved by said actuator in the direction toward or away from said roll.

13. An on-line roll grinding apparatus according to claim 10, wherein said rail moving means further comprises a screw rotated by said actuator, a stopper movable in the direction toward or away from said roll with the rotation of said screw, and urging means for holding said rail frame in abutment with said stopper.

14. An on-line roll grinding apparatus according to claim 8, wherein said rail tilting means includes cross blocks provided on said opposite stands for coming into abutment with roll chocks to press the same, said roll chocks supporting respective ends of corresponding one of said rolls, and rail moving means for holding both ends of said rail frame in abutment with said cross blocks so that said rail frame is movable integrally with said cross blocks.

15. An on-line roll grinding apparatus according to claim 8, wherein said abrasive layer includes cubic boron nitride abrasives or diamond abrasives.

16. An on-line roll grinding apparatus according to claim 8, wherein said grinding wheel is disposed such that a contact line between said abrasive layer and said roll is defined only in one side as viewed from the center of said grinding wheel.

17. An on-line roll grinding apparatus according to claim 1, wherein said planar wheel disk has a spring constant of 1000 Kgf/mm to 30 Kgf/mm.

18. An on-line roll grinding apparatus according to claim 1, wherein said planar wheel disk has a spring constant of 500 Kgf/mm to 50 Kgf/mm.

19. An on-line roll grinding apparatus according to claim 8, wherein said planar wheel disk has a spring constant of 1000 Kgf/mm to 30 Kgf/mm.

20. An on-line roll apparatus according to claim 8, wherein said planar wheel disk has a spring constant of 500 Kgf/mm to 50 Kgf/mm.

21. An on-line grinding apparatus for use with a rolling mill having a rotating roll to be ground which is rotatable about a roll axis, comprising:

a grinding wheel having a grinding wheel axis, said grinding wheel including abrasion material at an outer circumferential region thereof and being elastically bendable with respect to said wheel axis, a bearing support rotatably supporting the grinding wheel, a grinding wheel drive rotatably driving said grinding wheel, and a mechanism facilitating movement of said bearing support substantially in parallel with a roll axis of a roll to be ground by the grinding wheel while adjusting the angular inclination of the wheel axis and roll axis as a function of an axial location of the grinding wheel along the axial length of the roll.

22. An on-line grinding apparatus according to claim 21, wherein said grinding wheel comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll.

23. An on-line grinding apparatus according to claim 21, wherein said rolling mill includes roll stands at respective opposite ends of said roll, wherein said bearing support is carried by a rail frame extending between and supported at said roll stands, and wherein said mechanism includes adjustable connecting members disposed between respective end sections of said rail frame and respective ones of said roll stands.

24. An on-line grinding apparatus according to claim 23, wherein said grinding wheel comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll.

25. An on-line grinding apparatus according to claim 21, wherein said rolling mill is a roll crossing mill with at least one pair of rolls rotatably supported at roll stands so they can be crossed with respect to each other, and wherein said grinding apparatus includes two of said grinding wheels for said roll being ground.

26. An on-line grinding apparatus according to claim 25, wherein each of said grinding wheels comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll.

27. An on-line grinding apparatus according to claim 25, wherein respective bearing supports for each of said two grinding wheels are carried by a rail frame extending between roll stands supporting said rolls, said bearing supports being supported with their associated grinding wheel axes inclined at respective different angles with respect to the roll axis of the roll being ground, and wherein adjusting means are provided for changing the angle of said rail frame to be parallel with the axis of the roll axis of the roll being ground.

28. An on-line grinding apparatus according to claim 27, wherein each of said grinding wheels comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll.

29. An on-line grinding apparatus according to claim 21, wherein said mechanism includes means for inclining the wheel axis in a direction so that a circumferential periphery of the wheel containing grinding abrasive engages the roll at a side to the wheel corresponding to an adjacent end of the roll.

30. An on-line grinding apparatus according to claim 29, wherein said grinding wheel comprises a substantially planar wheel disk attached to said spindle and an abrasive layer fixed to one side of said planar wheel disk at a location spaced radially outwardly of a rotational axis of said wheel, said planar wheel disk being configured to elastically bend about said axis and function by itself as an elastic body to absorb vibration transmitted from said roll.

31. An on-line grinding apparatus according to claim 23, wherein said adjusting members are rotatable threaded members.

32. An on-line grinding apparatus according to claim 21, wherein said planar wheel disk has a spring constant of 1000 Kgf/mm to 30 Kgf/mm.

33. An on-line grinding apparatus according to claim 21, wherein said planar wheel disk has a spring constant of 500 Kgf/mm to 50 Kgf/mm.

* * * * *